US009213276B2

(12) United States Patent
Mitani et al.

(10) Patent No.: US 9,213,276 B2
(45) Date of Patent: Dec. 15, 2015

(54) IMAGE FORMING APPARATUS

(71) Applicant: CANON KABUSHIKI KAISHA, Tokyo (JP)

(72) Inventors: Takanori Mitani, Tokyo (JP); Satoshi Nishida, Numazu (JP); Hideo Nanataki, Yokohama (JP); Akimichi Suzuki, Yokohama (JP); Shogo Kan, Yokohama (JP); Kensuke Umeda, Kawasaki (JP); Takaaki Akamatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/253,252

(22) Filed: Apr. 15, 2014

(65) Prior Publication Data

US 2014/0314458 A1 Oct. 23, 2014

(30) Foreign Application Priority Data

Apr. 17, 2013 (JP) ..... 2013-086375
Apr. 30, 2013 (JP) ..... 2013-095195
Mar. 24, 2014 (JP) ..... 2014-060011

(51) Int. Cl.
*G03G 15/20* (2006.01)

(52) U.S. Cl.
CPC ..... *G03G 15/2028* (2013.01); *G03G 15/2017* (2013.01); *G03G 15/206* (2013.01); *G03G 2215/2035* (2013.01)

(58) Field of Classification Search
CPC ..... G03G 15/2003; G03G 15/2064
USPC ..... 399/122, 328, 329
See application file for complete search history.

(56) References Cited

U.S. PATENT DOCUMENTS 5,162,634 A * 11/1992 Kusaka et al. ..... 219/216
5,210,579 A 5/1993 Setoriyama et al.
5,960,243 A * 9/1999 Daigo et al. ..... 399/329
6,505,028 B1 * 1/2003 Yoda et al. ..... 399/329
7,162,194 B2 1/2007 Hotta et al.
7,203,438 B2 4/2007 Omata et al.
7,206,541 B2 4/2007 Fukita et al.
7,519,320 B2 4/2009 Aoki et al.
7,599,637 B2 10/2009 Nanataki et al.

(Continued)

FOREIGN PATENT DOCUMENTS

EP 0488357 A2 6/1992
GB 2490230 A 10/2012

(Continued)

OTHER PUBLICATIONS

European Search Report issued in counterpart European Patent Application No. 14164916.0, dated Feb. 15, 2015.

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes an image forming portion; and a fixing portion. The fixing portion includes a cylindrical film, a nip-forming member and a roller including a shaft portion and an elastic layer. The elastic layer contacts an outer surface of the film except an end region of the film with respect to a generatrix direction. In the end region, the shaft portion and the outer surface of the film oppose each other with a spatial region with respect to a radial direction of the shaft portion. The image forming apparatus includes a spacer occupying at least a part of the spatial region.

17 Claims, 20 Drawing Sheets

(56) References Cited

U.S. PATENT DOCUMENTS

| | | | | |
|---|---|---|---|---|
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 7,787,792 | B2 | 8/2010 | Nishida | |
| 7,865,102 | B2 | 1/2011 | Nanataki et al. | |
| 8,229,338 | B2 | 7/2012 | Nanataki et al. | |
| 8,285,183 | B2 | 10/2012 | Nishida et al. | |
| 8,483,603 | B2 | 7/2013 | Nihonyanagi et al. | |
| 8,532,530 | B2 | 9/2013 | Nishida et al. | |
| 2009/0257794 | A1 | 10/2009 | Kaino et al. | |
| 2011/0222931 | A1* | 9/2011 | Shinshi et al. | 399/329 |
| 2011/0243620 | A1 | 10/2011 | Mitsuhashi et al. | |
| 2012/0155938 | A1 | 6/2012 | Tanaka et al. | |
| 2012/0230742 | A1 | 9/2012 | Nakagawa et al. | |
| 2012/0243894 | A1 | 9/2012 | Umeda et al. | |
| 2012/0269562 | A1 | 10/2012 | Hashimoto | |
| 2012/0328341 | A1 | 12/2012 | Okayasu et al. | |
| 2014/0023413 | A1 | 1/2014 | Shinji et al. | |

FOREIGN PATENT DOCUMENTS

| | | | |
|---|---|---|---|
| JP | 8-184992 | A | 7/1996 |
| JP | 2000-3070 | A | 1/2000 |

* cited by examiner (a)

(b)

(a)

(b)

(a)

(b)

(a)

(b)

(c)

| DISTANCE FROM 600L TO S2 | (1) | (2) | (3) | (4) |
|---|---|---|---|---|
| EMB. 13 | 2.0(mm) | 2.2(mm) | 2.4(mm) | 2.5(mm) |
| COMP. EX. 3 | 2.0(mm) | 2.0(mm) | 2.0(mm) | 2.0(mm) |
| COMP. EX. 4 | 2.5(mm) | 2.5(mm) | 2.5(mm) | 2.5(mm) |

| | SURFACE TEMPERATURE (°C) |
|---|---|
| RECORDING MATERIAL | 125 |
| FILM | 180 |
| PRESSING ROLLER | 130 |

(a)

(b)

(c)

| DISTANCE FROM 600L TO S2 | (1) | (2) | (3) | (4) |
|---|---|---|---|---|
| MODIFIED EMB. 13 | 2.0(mm) | 2.2(mm) | 2.4(mm) | 2.5(mm) |
| COMP.EX. 4 | 2.5(mm) | 2.5(mm) | 2.5(mm) | 2.5(mm) |

IMAGE FORMING APPARATUS

FIELD OF THE INVENTION AND RELATED ART

The present invention relates to an image forming apparatus, such as an electrophotographic copying machine or an electrophotographic printer, in which a fixing device (fixing apparatus) is mounted.

As the fixing device mounted in the copying machine or the printer of an electrophotographic type, the fixing device of a film heating type has been known. This film heating type fixing device includes a heater including a ceramic substrate and a heat generating resistor formed on the substrate, a cylindrical film movable in contact with the heater, a pressing roller for forming a nip together with the heater via the film, and the like. A recording material on which a toner image (unfixed toner image) is carried is nipped and fed through the nip, so that the toner image on the recording material is heat-fixed on the recording material.

The fixing device of this type has an advantage such that a time from supply of electric power to the heater until a recording material of the fixing device increases to a fixable temperature is short. Accordingly, the printer in which this fixing device is mounted is capable of shortening a time (first print-out time (FPOT)) from input of a print command (instruction) until an image on a first sheet is outputted. Further, the fixing device of this type also has an advantage such that electric power consumption during stand-by in which the printer waits for the print command is low.

Incidentally, as a constituent material of a toner for electrophotography in recent years, a parting wax is contained in many cases. This is because an effect such as adjustment of glossiness of a printed image and improvement in dispersibility of a pigment is imparted, and in addition, the parting wax is added in order to prevent fixing offset. As a phenomenon of the fixing offset, there are some types as shown below.

In a fixing process of the toner image on the recording material, in the case where heating of the film is insufficient (in the case where a film temperature is low), the toner is not sufficiently melted to decrease fixing strength to the recording material, and therefore a part of the toner is deposited on the film surface. This phenomenon is called a cold offset, and the portion where the toner is deposited on the film surface appears as loss of the image. Further, the fixing strength of the fixed toner is weak, and therefore there is a possibility that the toner is peeled off from the recording material by friction or the like.

On the other hand, in the case where the film temperature is excessively high, although melting of the toner is sufficient, a viscosity of the toner is lowered, so that a part of the melted toner is peeled off from the recording material to contaminate the film surface. This phenomenon is called a hot offset, and results in the loss of the image similarly as in the cold offset.

Therefore, Japanese Laid-Open Patent Application (JP-A) Hei 8-184992 proposes that a wax component is added as a parting agent into a toner in the case where a fixing offset is prevented. By incorporating the parting wax into the toner, the parting wax moves to an interface between the melted toner and a fixing member during heat fixing, thus improving an anti-offset performance. Further, JP-A 2000-3070 proposes, in order to improve the anti-offset performance, a technique in which parting waxes of two or more types are added into a toner.

Incidentally, the pressing roller includes a core metal, an elastic layer formed on the core metal and a parting layer formed on the elastic layer, and in order to prevent protrusion of the pressing roller from an end surface of the film, a length of each of the elastic layer and the parting layer is shorter than a full length of the film. For that reason, a gap (spacing) corresponding to a total thickness of the elastic layer and the parting layer is created between the film and the core metal protruded from the elastic layer and the parting layer of the pressing roller.

Further, the parting wax contained in the toner image is liquefied by simultaneous heating and pressing while the recording material is nipped and fed by the film and the pressing roller at a nip. Most of the parting wax is transferred together with the toner image onto the recording material and then is fixed on the recording material, but a part of the parting wax is vaporized to be placed in a vaporized state. The vaporized component of the parting wax floats in the air in the fixing device in the form of airborne small diameter particles, of 0.1 μm or less in diameter, in a liquid phase or a solid phase depending on an ambient temperature.

However, by the presence of the gap described above, airflow is generated in the fixing device when the recording material is fed, thus strengthen the action of pushing out the air in the fixing device together with the recording material to an outside of the printer, so that the small diameter particles are discharged to an outside of the fixing device (apparatus) in some cases.

SUMMARY OF THE INVENTION

A principal object of the present invention is to provide an image forming apparatus including a fixing portion (fixing device) capable of reducing the number of ultrafine particles, vaporized from a parting wax contained in the toner image, discharged to an outside of the image forming apparatus.

According to an aspect of the present invention, there is provided an image forming apparatus for forming a toner image on a recording material, comprising: an image forming portion for forming the toner image on the recording material; and a fixing portion for fixing the toner image on the recording material by heating the toner image at a nip while feeding the recording material on which the toner image is carried, wherein the fixing portion includes a cylindrical film, a nip-forming member contacting an inner surface of the film and a roller, including a shaft portion and an elastic layer formed outside the shaft portion, for forming the nip together with the nip-forming member via the film, wherein the elastic layer contacts an outer surface of the film except an end region of the film with respect to a generatrix direction, and in the end region, the shaft portion and the outer surface of the film oppose each other with a spatial region with respect to a radial direction of the shaft portion, and wherein the image forming apparatus includes a spacer occupying at least a part of the spatial region.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings. Although the following embodiments are examples of preferred embodiments of the present invention, the present invention is not limited to the following embodiments, but various constitutions can be replaced with other known constitutions within the scope of ideas of the present invention.

[Embodiment 1]

(1) Image Forming Apparatus

Figure 1:
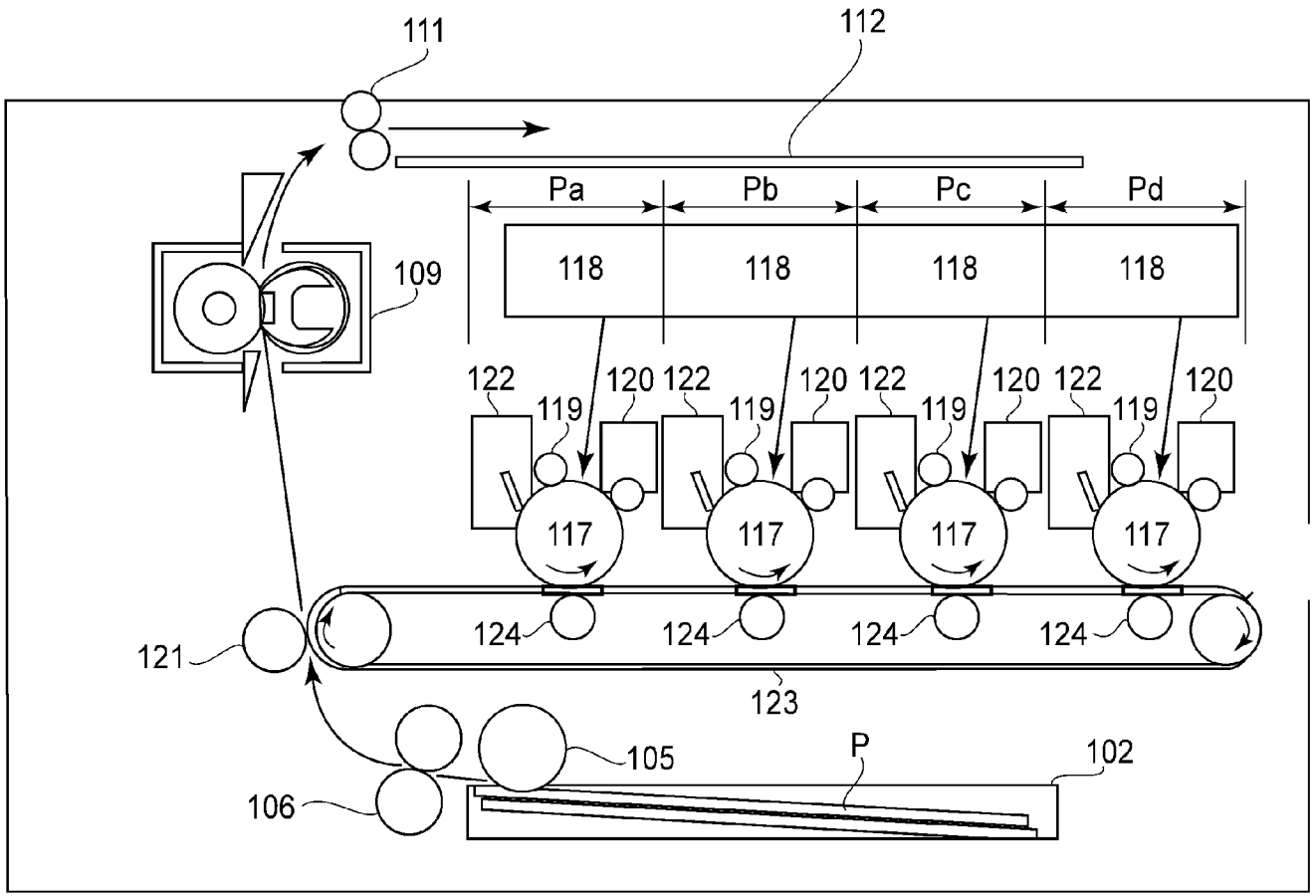
FIG. 1 is a sectional view of an image forming apparatus.

FIG. 1 is a sectional view showing a schematic structure of an image forming apparatus, according to the present invention, in which a fixing device (apparatus) is mountable. This image forming apparatus is a full-color printer using electrophotographic recording technology.

An image forming portion for forming a toner image on a recording material P includes four image forming stations Pa, Pb, Pc and Pd. Each of the image forming stations includes a photosensitive member 117, a charging member 119, a laser scanner 118, a developing device 120, a transfer member 124 and a cleaner 122 for cleaning the photosensitive member 117. Further, the image forming portion includes a belt 123 for conveying the toner image while carrying the toner image, and a secondary transfer roller 121 for transferring the toner image from the belt 123 onto the recording material P. An operation of the image forming portion described above is well known and will be omitted from detailed description.

Sheets of the recording material P is fed one by one from a cassette 102 by rotation of a roller 105 and then is fed to a secondary transfer nip, formed by the belt 123 and the secondary transfer roller 121, by rotation of a roller pair 106. The recording material P on which a toner image (unfixed toner image) is transferred at the secondary transfer nip is sent to a fixing portion 109, so that the toner image is heat-fixed on the recording material P at the fixing portion 109.

The recording material P coming out of the fixing portion 109 is discharged onto a tray 112 by rotation of a roller pair 111.

(2) Fixing Portion (Fixing Device) 109

Figure 2:
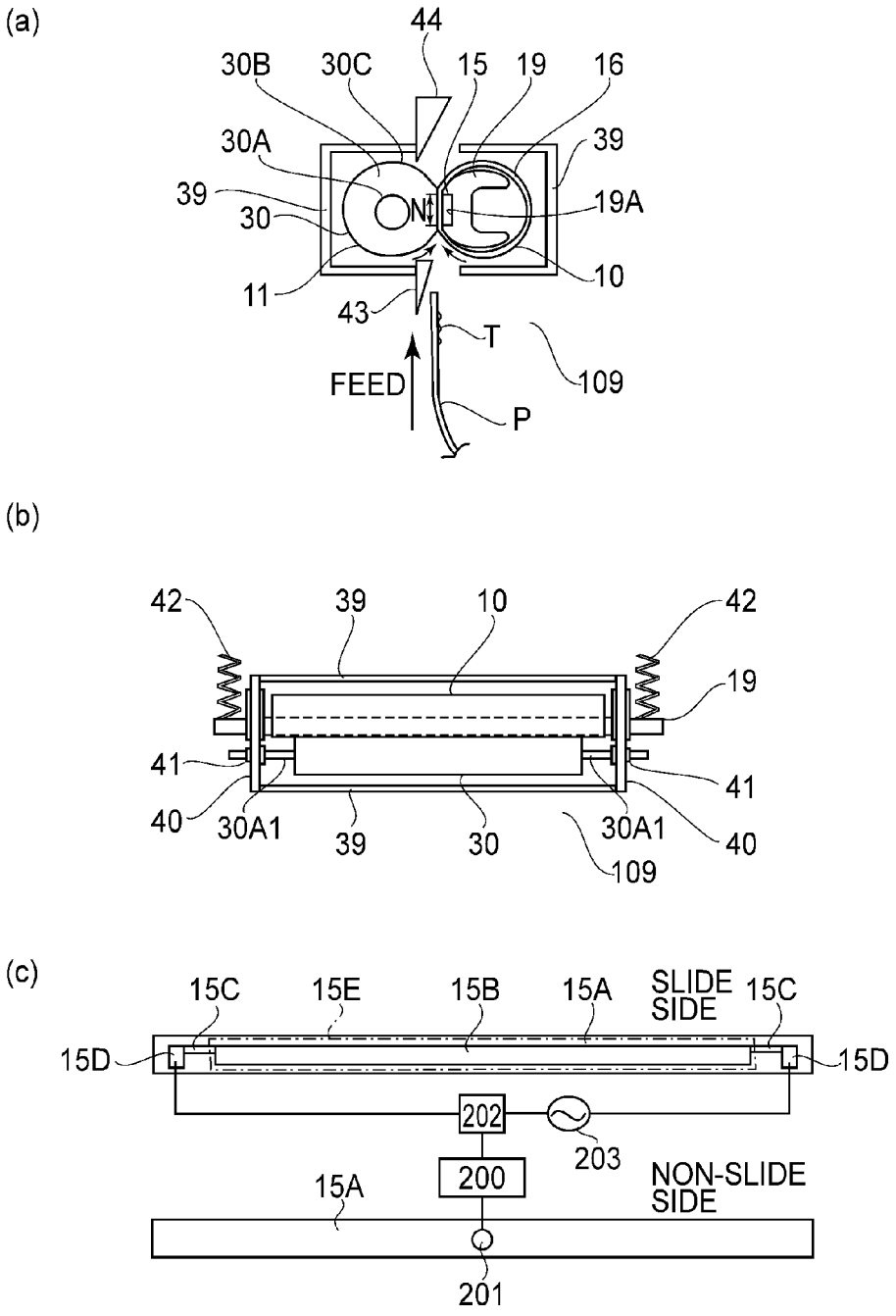
In FIG. 2, (a) is a sectional view of a fixing device in Embodiment 1, (b) is a front view of the fixing device in Embodiment 1, and (c) is a schematic view of a heater for heating the fixing device.

The direction constituting the fixing portion 109 will be described. Part (a) of FIG. 2 is a sectional view showing a schematic structure of the fixing device 109 in this embodiment. Part (b) of FIG. 2 is a front view of the fixing device 109 as seen in a recording material feeding direction. Part (c) of FIG. 2 is a schematic view showing a structure of a ceramic heater 15 of the fixing device 109.

The fixing device 109 includes a heating unit 10 and a pressing roller 30 as a pressing member. The heating unit 10 includes a cylindrical film (endless film) 16, a film guide 19 as a supporting member, the ceramic heater (heat source) 15 as a nip-forming member, and the like. Each of the film 16, the film guide 19, the ceramic heater 15 and the pressing roller 30 is an elongated member with respect to a direction (longitudinal direction) perpendicular to the recording material feeding direction ((a) of FIG. 2).

The heater 15 is supported by the film guide 19, and the film 16 is externally engaged loosely with the film guide 19. The film 16 is sandwiched between the heater 15 and the pressing roller 30 to form a nip N between the film 16 and the pressing roller 30.

The respective members will be further described specifically. The pressing roller 30 includes a round shaft-like core metal (shaft portion) 30A of a metal material such as iron, SUS or aluminum. On an outer peripheral surface of a portion of the core metal 30A between shaft-supporting portions 30A1 ((b) of FIG. 2) provided at longitudinal end portions of the core metal 30A, an elastic layer 30B is principally formed of a silicone rubber or the like in a roller shape. Further, on an outer peripheral surface of the elastic layer 30B, a parting layer 30C principally consisting of PTFE, PFA, FEP or the like is formed. The shaft-supporting portions 30A1 provided at the end portions of the core metal 30A are rotatably supported, via bearings 41, by left and right side plates 40 constituting a part of a metal frame 39 of the fixing device 109.

The film guide 19 is formed of a predetermined heat-resistant material in a substantially recessed shape in cross section. On a flat surface of the film guide 19 in the pressing roller 30 side, a groove 19A is formed along a longitudinal direction of the film guide 19, and the heater 15 is supported by the groove 19A.

The heater 15 includes a thin plate support 15A principally formed of ceramic such as alumina or aluminum nitride. On a film slide surface of the support 15A in the film 16 side, a heat generating resistor 15B principally formed of silver, palladium or the like is formed in a pattern along a longitudinal direction of the support 15A by printing. Further, on the film slide surface, an electroconductive portion 15C for supplying electric power to the heat generating resistor 15B, and an electrode portion 15D for supplying electric power to the heat generating resistor 15B are formed by pattern printing. Further, on the film slide surface, a protective layer 15E principally formed of glass or heat-resistant resin such as fluorine-containing resin or polyimide is provided so as to cover the heat generating resistor 15B.

The film 16 is formed in a cylindrical shape so that an inner peripheral length thereof is longer than an outer peripheral length of the film guide 19 and is externally engaged loosely with the film guide 19 under no tension. As a layer structure of the film 16, a two-layer structure such that an outer peripheral surface of an endless belt-like base layer principally formed of polyimide is covered with an endless belt-like surface layer principally formed of PFA is employed.

The film 16 externally engaged with the film guide 19 is disposed in parallel to the pressing roller 30, and the longitudinal end portions of the film guide 19 are urged in the horizontal direction perpendicular to a generatrix direction of the pressing roller 30 by a pressing spring 42. The heater 15 supported by the film guide 19 causes the film 16 to contact the outer peripheral surface of the pressing roller 30 in a pressed state by a pressing force of the pressing spring 42. As a result, the elastic layer 30B of the pressing roller 30 is collapsed and elastically deformed, so that the nip N ((a) of FIG. 2) having a predetermined width is formed between the pressing roller surface and the outer peripheral surface of the film 16.

In (a) of FIG. 2, a guide 43 guides the recording material P into the nip N, and a guide 44 guides the recording material P discharged from the nip N.

A heat-fixing operation of the fixing device 109 will be described with reference to (a) and (c) of FIG. 2. A driving force of a motor (not shown) provided in the image forming apparatus is transmitted to a gear (not shown) provided at a longitudinal end portion of the core metal 30A of the pressing roller 30, so that the pressing roller 30 is rotated in an arrow direction. The film 16 is rotated in an arrow direction by rotation of the pressing roller 30 while sliding with the protective layer 15E of the heater 15 at an inner peripheral surface (inner surface) thereof.

To the heat generating resistor 15B of the heater 15, electric power is supplied from a commercial power source 203 via a triac 202, so that the heat generating resistor 15B generates heat and thus the heater 15 is increased in temperature. The triac 202 is controlled by a controller 200 including CPU and memories such as RAM and ROM so that a detection temperature of a temperature detecting element 201 for monitoring a temperature of the substrate 15A at the film slide surface (back surface) is kept at a fixing temperature (target temperature).

The recording material P carrying thereon a toner image (unfixed toner image) T is guided into the nip N by the guide 43. Then, while the recording material P is nipped and fed through the nip N, heat of the heater 15 and pressure at the nip N are applied to the toner image T, so that the toner image T is heat-fixed on the recording material P. The recording material P coming out of the nip N is guided by the guide 44 and is sent to the roller pair 111.

(3) Ultrafine Particles of Parting Wax Contained in Toner

A parting wax is incorporated in the toner of the toner image carried on the recording material P. As described above, most of the parting wax is transferred together with the melted toner image T onto the recording material P and then is fixed on the recording material P, but a part of the toner is vaporized in a gas state (phase). A vaporized parting wax component floats in the air in the fixing device 109 in the form of small diameter particles of 0.1 μm or less in liquid phase or solid phase depending on the ambient temperature. At this time, by floating the small diameter particles in the air in the fixing device 109 for a long time, the small diameter particles are agglomerated or caught by peripheral members, so that it is possible to reduce the number of the small diameter particles discharged from the fixing device 109.

Figure 3:
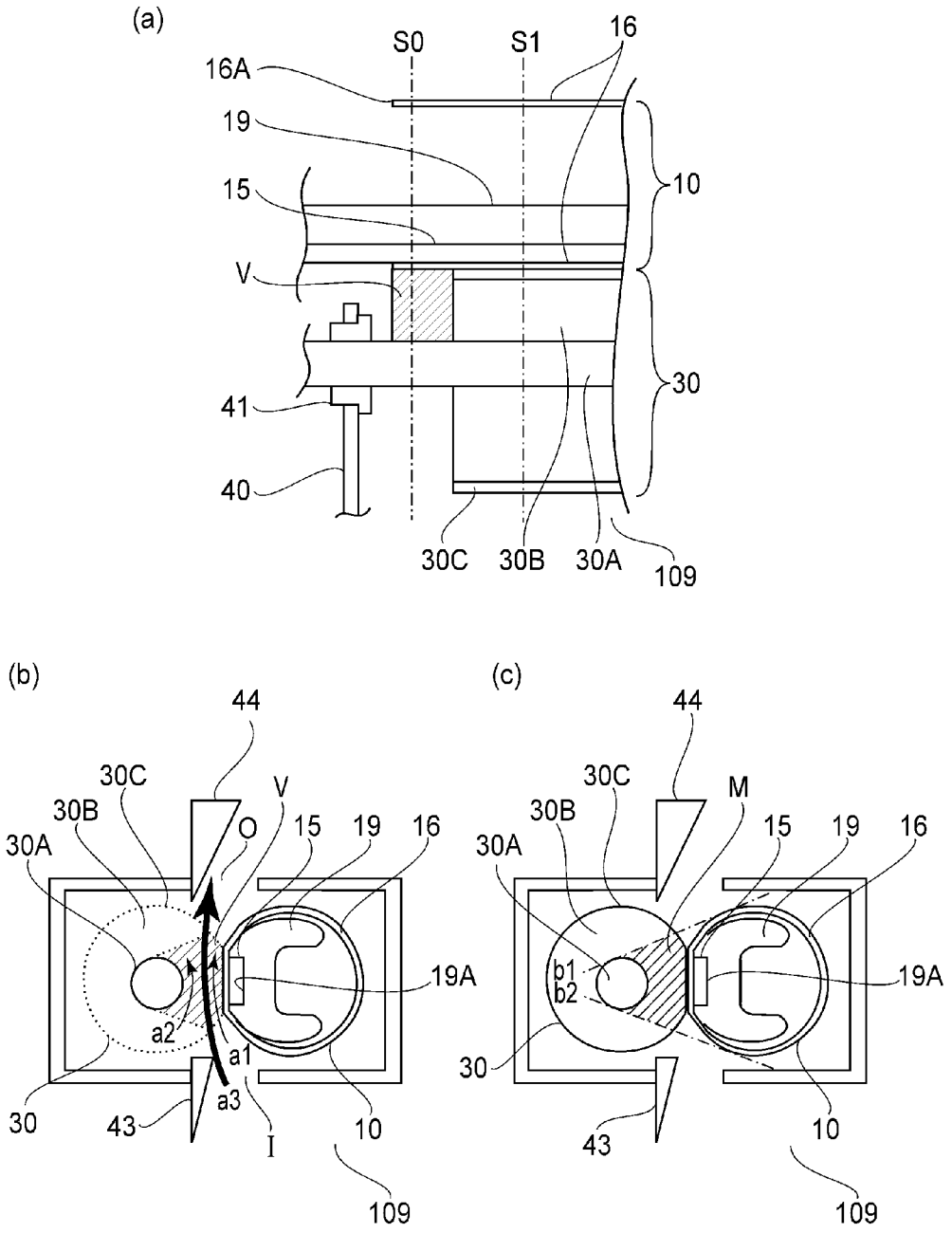
In FIG. 3, (a) is a sectional view of a longitudinal end portion of a film and a pressing roller in a fixing device in Comparison Example and the neighborhood of the longitudinal end portion, (b) is a sectional view of the fixing device in Comparison Example taken along a chain line S0 in (a), and (c) is a sectional view of the fixing device in Comparison Example taken along a chain line S1 in (a).

(4) Gap Between Film and Pressing Roller Core Metal in Fixing Device in Comparison Example Part (a) of FIG. 3 is a sectional view of a longitudinal end portion of the film 16 and the pressing roller 30 in the fixing device 109 in Comparison Example and the neighborhood of the longitudinal end portion. Part (b) of FIG. 3 is a sectional view of the fixing device 109 in Comparison Example taken along a chain line S0 in (a) of FIG. 3. Part (c) of FIG. 3 is a sectional view of the fixing device 109 in Comparison Example taken along a chain line S1 in (a) of FIG. 3.

The parting layer 30C and the elastic layer 30B of the pressing roller 30 are soft, and in the case where the layers slide with the peripheral members, there is a fear that the pressing roller 30 is damaged or broken. Therefore, in order to prevent the slide of the parting layer 30C with the heater 15, a longitudinal length of the pressing roller 30 is determined so that the parting layer 30C is protruded from an end surface 16A to an outside even when thermal expansion, dimensional tolerance and backlash of the pressing roller 30 and film 16 are taken into consideration.

In this way, the longitudinal lengths of the parting layer 30C and the elastic layer 30B are limited to short lengths, and as shown in (a) of FIG. 3, a part of the film 16 is ordinarily placed in a state in which the part of the film 16 is protruded to the outside without contacting the parting layer 30C and the elastic layer 30B with respect to the longitudinal direction. For this reason, between the core metal 20A and the film 16 which are protruded from the parting layer 30C and the elastic layer 30B to the outside, a gap (spacing) V corresponding to a total thickness of the parting layer 30C and the elastic layer 30B is created. Accordingly, in both longitudinal end sides of the pressing roller 30, the gap V is formed between the core metal 20A and the film 16.

Here, the gap V is defined as follows in a cross section in a nip N forming region indicated by the chain line S1 in (a) of FIG. 3. That is, a spatial region occupied when a plane (hatched portion M in (c) of FIG. 3) consisting of the elastic layer 30B and the parting layer 30C inside two tangential lines b1 and b2 each connecting the outer peripheral surface of the core metal 30A and the outer peripheral surface of the film 16 is extended to the end surface 16A of the film 16 is defined as a gap (spacing) region V.

Then, with reference to (b) of FIG. 3, a relationship between the gap region V and the airflow will be described. When the recording material P is fed, ambient air of the recording material P is moved together with the recording material P due to viscosity of the air. As a result, the air in the fixing device 109 is liable to flow from a recording material inlet I to a recording material outlet O of the fixing device 109. That is, the air in the fixing device 109 is liable to flow from an upstream-side recording material inlet I to a downstream-side recording material outlet O in the gap region V with respect to the recording material feeding direction. Further, also ambient air of the pressing roller 30 and the film 16 is moved together with the pressing roller 30 and the film 16 by rotation of the pressing roller 30 and the film 16. In the fixing device 109 in this Comparison Example, the ambient air of, e.g., the film 16 surface or the outer peripheral surface of the core metal 30A of the pressing roller 30 is moved together with the film 16 or the core metal 30A.

In the above gap region V, the ambient air of the film 16 surface or the core metal 30A surface is collected to generate airflow a3 while gradually changing a direction thereof. Specifically, in the gap region V, a movement direction a1 of the film 16 surface and a movement direction a2 of the core metal 30A surface coincide with each other, so that the airflow a3 directed from the recording material inlet I toward the recording material outlet O is generated. That is, the direction of the airflow with the feeding of the recording material P coincides with the direction of the airflow a3 in the gap region V, so that an amount of the airflow directed from the recording material inlet I toward the recording material outlet O is increased.

Further, the airflow direction also coincides with a direction of ascending airflow directed vertically upward by heat as a downstream exit of the nip surface, with respect to the recording material feeding direction, formed with respect to the vertical direction by the surface of the pressing roller 30 and the surface of the film 16 at the nip N approaches a vertically upward direction. For this reason, the amount of the airflow directed from the recording material inlet I toward the recording material outlet O is further increased.

In this way, by the presence of the gap region V in the both longitudinal sides of the pressing roller 30, an action of pushing out the air in the fixing device 109 to the outside of the image forming apparatus together with the recording material P becomes strong. As a result, the small diameter particles generated inside the fixing device 109 are discharged to the outside of the fixing device 109 in a short time, and therefore the agglomeration of the small diameter particles and the catch of the small diameter particles by the peripheral members are not generated sufficiently, so that many small diameter particles are discharged to the outside of the fixing device 109 in some cases.

(5) Airflow Suppressing Member

Figure 4:
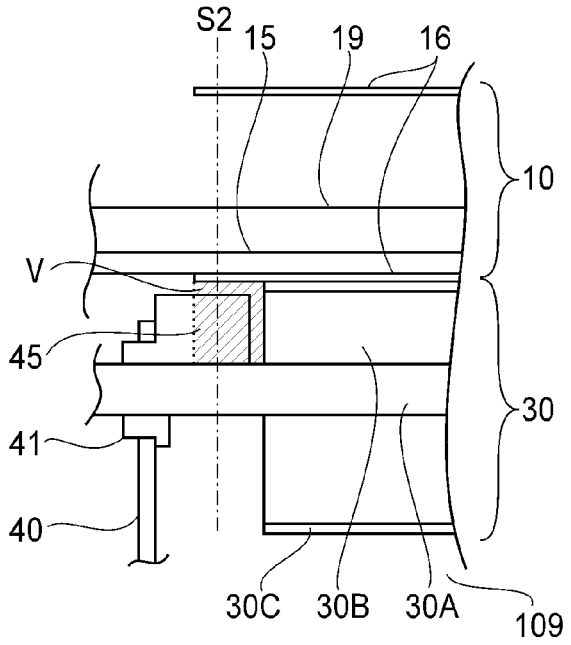
In FIG. 4, (a) is a sectional view of a longitudinal end portion of a film and a pressing roller in a fixing device in Embodiment 1 and the neighborhood of the longitudinal end portion, and (b) is a sectional view of the fixing device in Embodiment 1.
Figure 4:
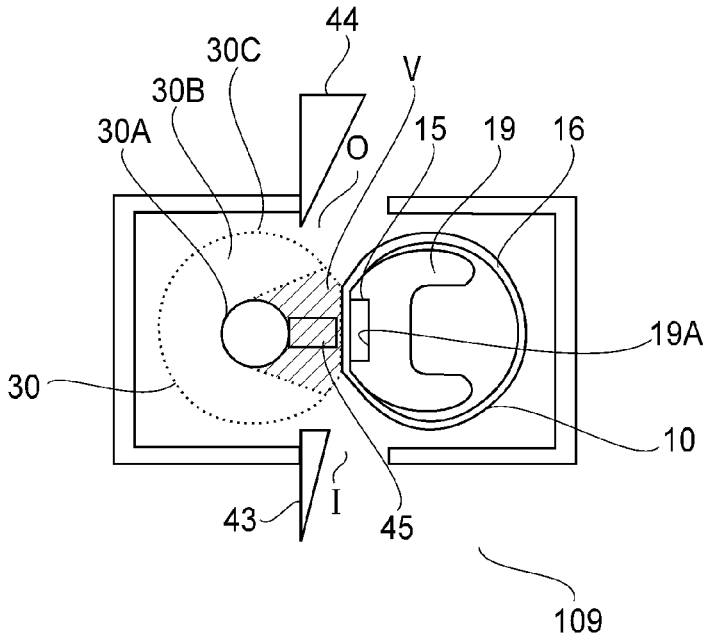

Part (a) of FIG. 4 is a sectional view showing a longitudinal end portion of the film 16 and the pressing roller 30 of the fixing device 109 in this embodiment and the neighborhood of the longitudinal end portion. Part (b) of FIG. 4 is a sectional view of the fixing device 109 in this embodiment taken along a chain line S2 in (a) of FIG. 4.

As shown in (a) and (b) of FIG. 4, the fixing device 109 is provided, in the above-described gap region V, an airflow suppressing member 45 for suppressing generation of the airflow when the recording material P carrying thereon the toner image is fed through the nip N. Specifically, a part of a member of the bearing 41 protrudes into the gap region V and functions as the airflow suppressing member 45. In other words, the airflow suppressing member 45 also functions as the bearing 41.

A shape of the airflow suppressing member 45 will be described. When the airflow suppressing member 45 slides strongly with the film 16, there is a fear that the film 16 is broken. In order to prevent the film 16 from being broken, there is a need to fix the airflow suppressing member 45 at a position spaced from the heater 15 by a distance corresponding to a film thickness or more. That is, it is desirable that the airflow suppressing member 45 is fixed at a position where a distance between the airflow suppressing member 45 and the heater 15 is larger than the thickness of the film 16. As a result, the film 16 is prevented from simultaneously receiving forces from both the airflow suppressing member 45 and the heater 15, and therefore there is no breakage of the film 16.

Further, there is a possibility that the portion of the film 16 protruded, toward the longitudinal outside, from the surface consisting of the elastic layer 30B and the parting layer 30C of the pressing roller 30 raises from the heater 15 by rigidity of the film 16 itself during a rotational operation of the film 16 and contacts the airflow suppressing member 45. However, the distance between the airflow suppressing member 45 and the heater 15 is larger than the thickness of the film 16, and therefore even when the above portion contacts the airflow suppressing member 45, the portion can escape toward the heater 15 side, so that it is possible to suppress the breakage of the film 16.

Further, when the airflow suppressing member 45 strongly slides with the parting layer 30C and the elastic layer 30B of the pressing roller 30, there is a fear that the parting layer 30C and the elastic layer 30B are broken. In order to suppress the breakage of the parting layer 30C and the elastic layer 30B, there is a need to prevent the airflow suppressing member 45 from contacting the parting layer 30C and the elastic layer 30B.

In this embodiment, the shape of the airflow suppressing member 45 was a rectangular parallelopiped. Further, in (a) of FIG. 4, a distance between the airflow suppressing member 45 and the film 16 was 0.5 mm, and the closest distance between the airflow suppressing member 45 and the elastic layer 30B was 0.5 mm. Further, the entire surface of the airflow suppressing member 45 was contacted to the surface of the core metal 30A with respect to the longitudinal direction of the pressing roller 30.

An experiment as the number of discharged small diameter particles with respect to the fixing device 109 in this embodiment (Embodiment 1) was conducted. The experiment was also conducted with respect to the fixing devices 109 in Comparison Example. The experiment was further conducted with respect to the fixing device 109 in this embodiment in both the case where the airflow suppressing member 45 was provided only in the longitudinal left side of the pressing roller 30 in the case where the airflow suppressing member 45 was provided in the longitudinal both (left and right) sides of the pressing roller 30. Further, the experiment was conducted with respect to the fixing devices 109 in Embodiment 1 and Comparison Example in the case where an angle of the fixing device was changed. Specifically, constitutions in which an angle of the nip surface of the nip N relative to the disposition surface of the image forming apparatus was 0 degrees and 90 degrees when a direction in which the exit of the nip N in the downstream side of the recording material feeding distance was taken as the positive direction were employed.

An evaluation method of the discharged number of the small diameter particles will be described. In this evaluation method, an inside of a hermetically sealed chamber of 3 $m^3$ in volume was filled with the air, and the image forming apparatus was disposed in the chamber. Then, a concentration (particles/$cm^3$) of the small diameter particles after an image of 5% in print ratio was printed for 10 minutes was measured by using a nanoparticle size distribution measuring device ("FMPS3091", manufactured by TSI Inc.).

Table 1 shows the concentration of the small diameter particles in each of conditions when a measured value of the concentration of the small diameter particles in Comparison Example 1 (in which the airflow suppressing member 45 was not provided and the nip surface angle relative to the horizontal surface is 90 degrees) was 1.

TABLE 1

| | ASM*1 | | NSA*2 | CONC*3 |
|---|---|---|---|---|
| | LEFT | RIGHT | (deg.) | (particles/$cm^3$) |
| COMP. EX. 1 | NO | NO | 90 | 1 |
| COMP. EX. 2 | NO | NO | 0 | 0.9 |
| EMB. 1 | YES | NO | 0 | 0.6 |
| | YES | YES | 0 | 0.02 |
| | YES | NO | 90 | 0.7 |
| | YES | YES | 90 | 0.03 |

*1"ASM" represents the airflow suppressing member. "YES" is the presence of the airflow suppressing member, and "NO" is the absence of the airflow suppressing member.
*2"NSA" represents the nip surface angle (degrees) relative to the horizontal surface.
*3"CONC" represents the concentration (particles/$cm^3$) of the small diameter particles.

From Table 1, with respect to the fixing devices 109 in this embodiment (in which the airflow suppressing member was provided in only the left side or in both the left and right sides), the number of the discharged small diameter particles was able to be suppressed by providing the airflow suppressing member 45 in the gap region V. Further, it is understood that a suppression ratio of the number of the discharged small diameter particles is larger in the fixing devices 109 having the constitution in which the airflow suppressing member 45 is provided in the both longitudinal sides, not in only the longitudinal left side, in the longitudinal gap regions V with respect to the longitudinal direction of the pressing roller 30. Further, it is understood that the suppression ratio of the number of the discharged small diameter particles is larger in the fixing devices 109 having the constitution in which the exit of the nip N is directed upward.

Further, although the result is not shown in Table 1, in also the fixing device 109 having a constitution in which the nip surface angle relative to the horizontal surface is between 0 degrees and 90 degrees, the number of the discharged small diameter particles can be suppressed. As a result, it was confirmed that the suppression ratio was larger with a larger angle.

That is, in the constitution in this embodiment, a suppressing effect of the number of the discharged small diameter particles is enhanced when a recording material discharging direction at the nip N has a vertically upward component relative to the disposition surface of the image forming apparatus.

The fixing device 109 in this embodiment is provided with the airflow suppressing member 45 in the gap region V, and therefore the gap region V can be shielded by the airflow suppressing member 45, so that the action of pushing out, together with the recording material P, the air in the fixing device 109 with the feeding of the recording material P can be weakened. As a result, the generation of the airflow a3 directed from the recording material inlet I toward the recording material outlet O can be suppressed, so that the flow of the air in the fixing device 109 can be made small. As a result, it becomes possible to increase a time until the small diameter particles generated in the fixing device 109 are discharged to the outside of the fixing device 109. For that reason, until the small diameter particles are discharged to the outside of the fixing device 109, the agglomeration of the small diameter particles and the catch of the small diameter particles by the peripheral members readily occur, so that an effect such that the number of the small diameter particles discharged to the outside of the direction 109 can be decreased is achieved.

It is more effective that the airflow suppressing member 45 is provided in the gap region V in both the longitudinal end sides of the pressing roller 30. In the case where the shielding of one of the gap regions V in the longitudinal end sides of the pressing roller 30 is not sufficient, the airflow concentrates at the one of the gap regions V, so that there is the case where an airflow rate is not lowered and thus the number of the small diameter particles cannot be decreased.

Further, in the fixing device 109 in this embodiment, the airflow suppressing member 45 also functions as the bearing 41 and therefore the above-described effect can be obtained without upsizing the fixing device 109 and the image forming apparatus itself.

[Embodiment 2]

Figure 5:
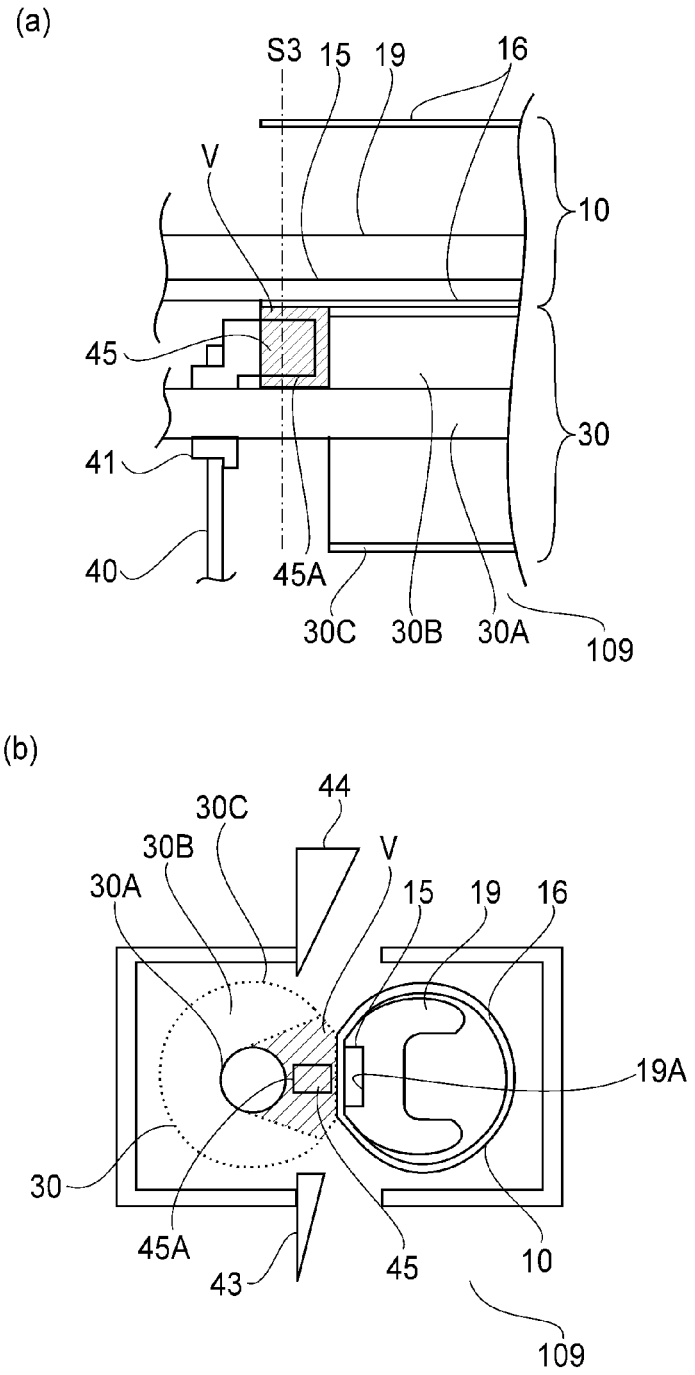
In FIG. 5, (a) is a sectional view of a longitudinal end portion of a film and a pressing roller in a fixing device in Embodiment 2 and the neighborhood of the longitudinal end portion, and (b) is a sectional view the fixing device in Embodiment 2.

FIG. 5 is an illustration of a fixing device 109 in this embodiment. In FIG. 5, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S3 in (a) of FIG. 5.

The fixing device 109 in Embodiment 1 has a constitution in which the entire surface of the airflow suppressing member 45 is contacted to the surface of the core metal 30A with respect to the longitudinal direction of the pressing roller 30. The fixing device 109 in this embodiment has the same constitution as the fixing device 109 in Embodiment 1 except that a part of the airflow suppressing member 45 is prevented from contacting the surface of the core metal 30A with respect to the longitudinal direction of the pressing roller 30.

As shown in (a) and (b) of FIG. 5, the airflow suppressing member 45 has a core metal opposite surface (end portion opposite surface) 45A, which is non-contact with the surface of the core metal 30A, formed as a part thereof with respect to the longitudinal direction of the pressing roller 30. By this constitution, an area in which the airflow suppressing member 45 and the core metal 30A slide with each other is decreased, so that an amount of discharge of the small diameter particles to the outside of the fixing device can be decreased while suppressing an increase in driving torque of the pressing roller 30. Further, by this constitution, it is possible to obtain an effect such that generation of frictional noise between the core metal 30A and the airflow suppressing member 45 can be suppressed.

[Embodiment 3]

Figure 6:
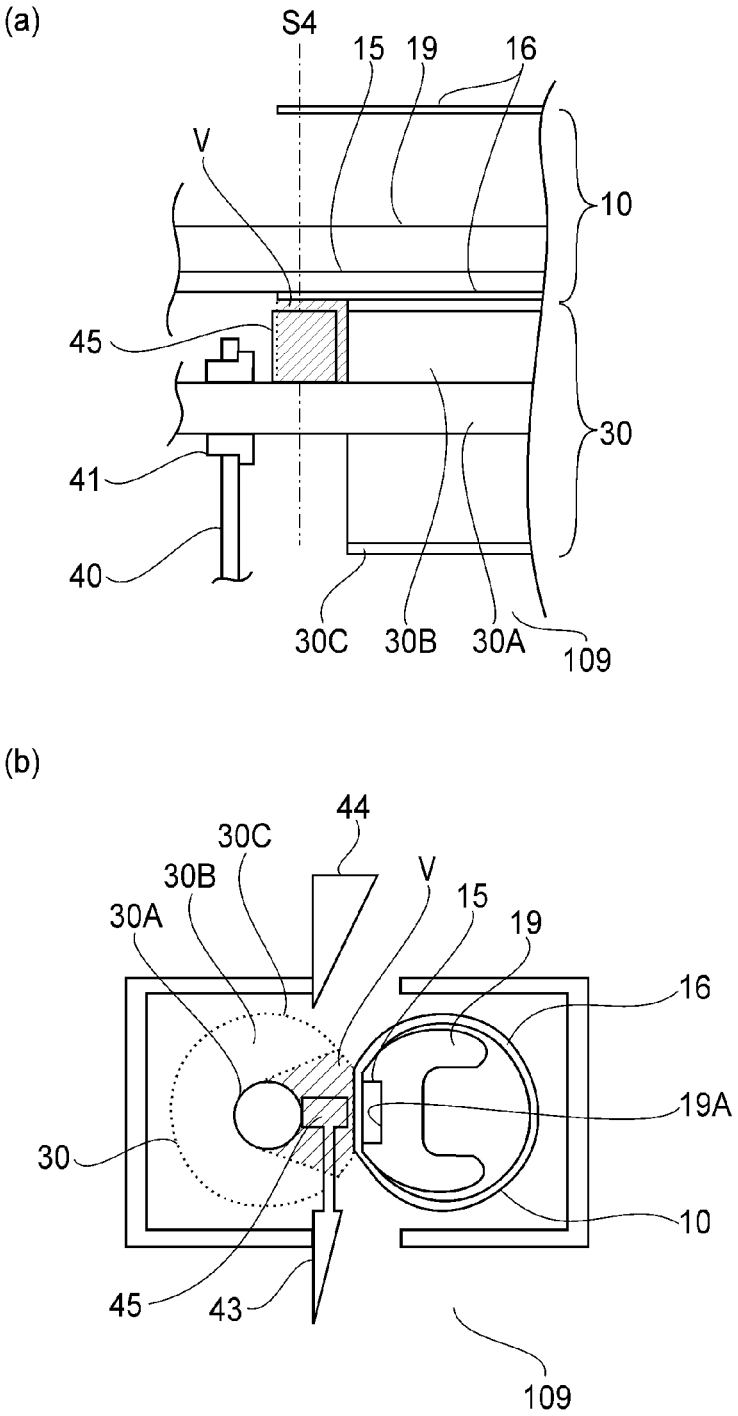
In FIG. 6, (a) is a sectional view of a longitudinal end portion of a film and a pressing roller in a fixing device in Embodiment 3 and the neighborhood of the longitudinal end portion, and (b) is a sectional view of the fixing device in Embodiment 3.

FIG. 6 is an illustration of a fixing device 109 in this embodiment. In FIG. 6, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S4 in (a) of FIG. 6.

The fixing device 109 in this embodiment has the same constitution as the fixing device 109 in Embodiment 1 except that an airflow suppressing member 45 also functions as a guide 43.

As shown in (a) and (b) of FIG. 6, a part of the guide 43 protrudes into the gap region V and functions as the airflow suppressing member 45. In other words, the airflow suppressing member 45 also has the function of the guide 43.

Also in the fixing device 109 in this embodiment, the airflow suppressing member 45 is provided in the gap region V, and therefore the effect described in Embodiment 1 can be obtained. Further, a constitution in which the airflow suppressing member 45 also functions as the guide 43 is employed, and therefore the above-described effect can be obtained without upsizing the fixing device 109 and the image forming apparatus itself.

In this embodiment, an example in which the guide 43 and the airflow suppressing member 45 are formed as a unit was described, but these members may also be formed as separate members and then may be integrally connected. For example, a resinous airflow suppressing member 45 and a metal guide 43 may be integrally connected with each other by using a fastening member such as a screw.

[Embodiment 4]

Figure 7:
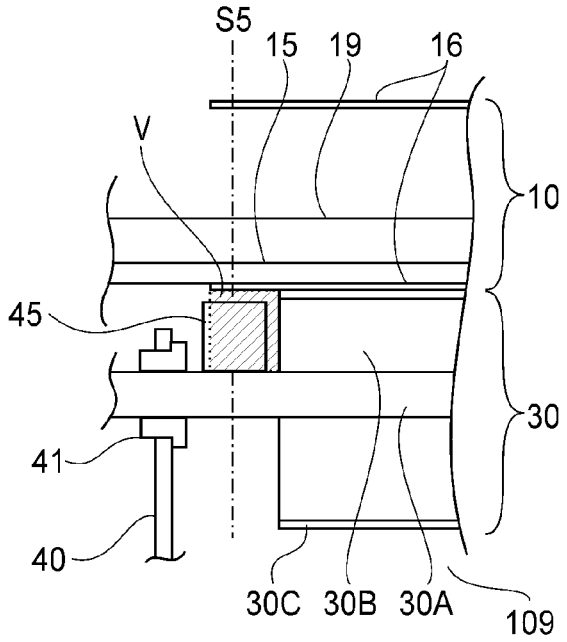
In FIG. 7, (a) is a sectional view of a longitudinal end portion of a film and a pressing roller in a fixing device in Embodiment 4 and the neighborhood of the longitudinal end portion, and (b) is a sectional view the fixing device in Embodiment 4.
Figure 7:
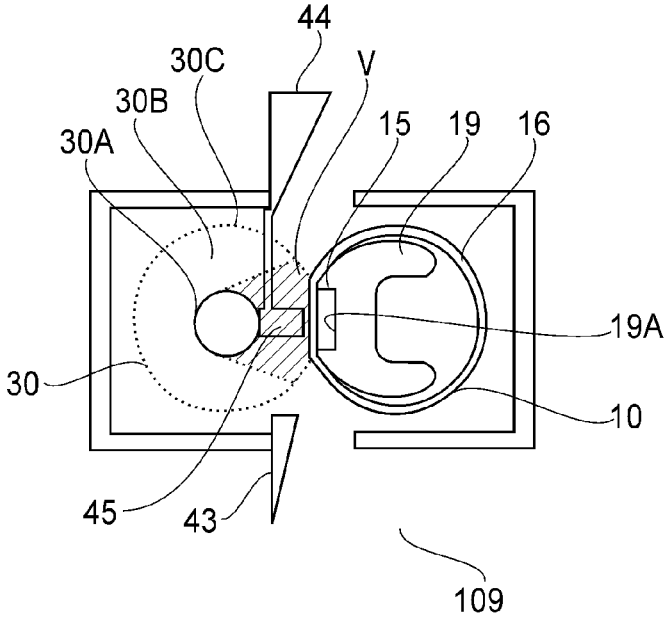

FIG. 7 is an illustration of a fixing device 109 in this embodiment. In FIG. 7, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S5 in (a) of FIG. 7.

The fixing device 109 in this embodiment has the same constitution as the fixing device 109 in Embodiment 1 except that an airflow suppressing member 45 also functions as a guide 44.

As shown in (a) and (b) of FIG. 7, a part of the guide 44 protrudes into the gap region V and functions as the airflow suppressing member 45. In other words, the airflow suppressing member 45 also has the function of the guide 44.

Also in the fixing device 109 in this embodiment, the airflow suppressing member 45 is provided in the gap region V, and therefore the effect described in Embodiment 1 can be obtained. Further, a constitution in which the airflow suppressing member 45 also functions as the guide 44 is employed, and therefore the above-described effect can be obtained without upsizing the fixing device 109 and the image forming apparatus itself.

In this embodiment, an example in which the guide 44 and the airflow suppressing member 45 are formed as a unit was described, but these members may also be formed as separate members and then may be integrally connected. For example, a resinous airflow suppressing member 45 and a metal guide 44 may be integrally connected with each other by using a fastening member such as a screw.

[Embodiment 5]

Figure 8:
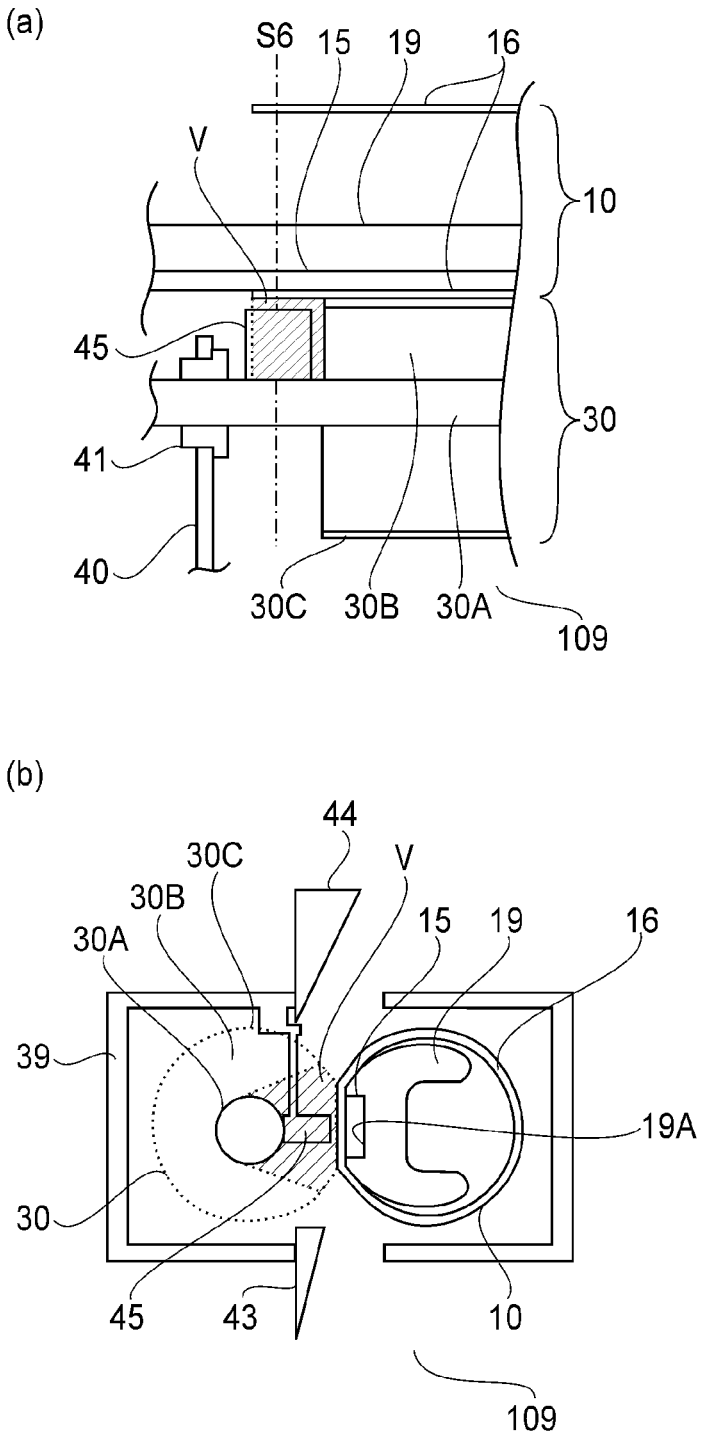
In FIG. 8, (a) is a sectional view of a longitudinal end portion of a film and a pressing roller in a fixing device in Embodiment 5 and the neighborhood of the longitudinal end portion, and (b) is a sectional view of the fixing device in Embodiment 5.

FIG. 8 is an illustration of a fixing device 109 in this embodiment. In FIG. 8, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S6 in (a) of FIG. 8.

The fixing device 109 in this embodiment has the same constitution as the fixing device 109 in Embodiment 1 except that an airflow suppressing member 45 also functions as a frame 39.

As shown in (a) and (b) of FIG. 8, a part of the frame 39 protrudes into the gap region V and functions as the airflow suppressing member 45. In other words, the airflow suppressing member 45 also has the function of the frame 39.

Also in the fixing device 109 in this embodiment, the airflow suppressing member 45 is provided in the gap region V, and therefore the effect described in Embodiment 1 can be obtained. Further, a constitution in which the airflow suppressing member 45 also functions as the frame 39 is employed, and therefore the above-described effect can be obtained without upsizing the fixing device 109 and the image forming apparatus itself.

In this embodiment, an example in which the frame 39 and the airflow suppressing member 45 are formed as a unit was described, but these members may also be formed as separate members and then may be integrally connected. For example, a resinous airflow suppressing member 45 and a metal frame 39 may be integrally connected with each other by using a fastening member such as a screw.

[Embodiment 6]

Figure 9:
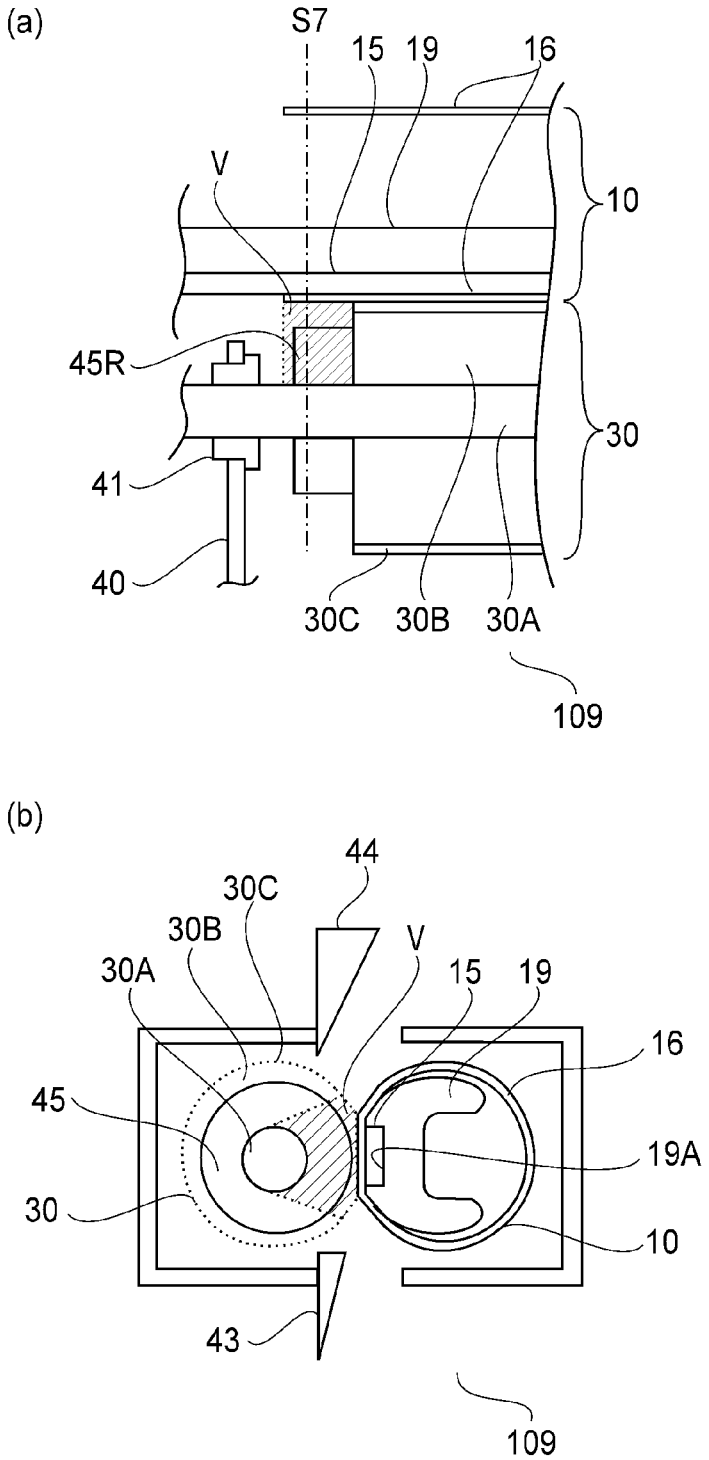
In FIG. 9, (a) is a sectional view of a longitudinal end portion of a film and a pressing roller in a fixing device in Embodiment 6 and the neighborhood of the longitudinal end portion, and (b) is a sectional view the fixing device in Embodiment 6.

FIG. 9 is an illustration of a fixing device 109 in this embodiment. In FIG. 9, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S7 in (a) of FIG. 9.

With respect to the fixing device 109 in Embodiments 1 to 5, an example in which a part of an immovable fixed member such as the bearing 41, the guide 43, the guide 44 or the frame 39 is used as the airflow suppressing member 45 was described. The fixing device 109 in this embodiment has the same constitution as the fixing device 109 in Embodiment 1 except that a constitution in which an airflow suppressing member 45R is formed on apart of members constituting the pressing roller 30 and is rotated together with the pressing roller 30 is employed.

Also in the fixing device 109 in this embodiment, the airflow suppressing member 45R is provided in the gap region V. Specifically, the airflow suppressing member 45R is formed on the surface of the core metal 30A. Further, a part of the airflow suppressing member 45R enters the gap region V.

A shape of the airflow suppressing member 45R will be described. When the airflow suppressing member 45R slides strongly with the film 16, there is a fear that the film 16 is broken. In order to prevent the film 16 from being broken, there is a need to fix the airflow suppressing member 45R at a position spaced from the heater 15 by a distance corresponding to a film thickness or more. That is, it is desirable that the airflow suppressing member 45R is fixed at a position where a distance between the airflow suppressing member 45 and the heater 15 is larger than the thickness of the film 16. Further, the airflow suppressing member 45R is rotated together with the core metal 30A of the pressing roller 30, and therefore the airflow suppressing member 45R may also contact the parting layer 30C and the elastic layer 30B.

In this embodiment, the shape of the airflow suppressing member 45R is a ring shape, and the airflow suppressing member 45R is engaged with and fixed on the core metal 30A. Further, in (a) of FIG. 9, a distance between the airflow suppressing member 45R and the film 16 was 0.5 mm. The airflow suppressing member 45R and the elastic layer 30B contact each other, and the airflow suppressing member 45R and the core metal 30A contact each other.

The airflow suppressing member 45R is formed of a material having a volumetric specific heat lower than the core metal 30A. As a result, thermal capacity of the airflow suppressing member 45R can be made smaller than that of the core metal 30A. As a result, when the nip N is heated up to a fixing temperature, the thermal capacity absorbed by the airflow suppressing member 45R can be decreased, so that energy of the fixing device 109 can be saved. In this embodiment, as a material for the airflow suppressing member 45R< a resinous member having a volumetric specific heat lower than iron as a material for the core metal 30A was used.

Also with respect to the fixing device 109 in this embodiment, the experiment as to the number of the discharged small diameter particles was conducted. The experimental method of the experiment and the evaluation method of the number of the discharged small diameter particles are same as those in Embodiment 1. A result thereof is shown in Table 2.

TABLE 2

| | ASM*1 | | NSA*2 | CONC*3 |
|---|---|---|---|---|
| | LEFT | RIGHT | (deg.) | (particles/cm$^3$) |
| COMP. EX. 1 | NO | NO | 90 | 1 |
| EMB. 6 | YES | NO | 0 | 0.5 |
| | YES | YES | 0 | 0.017 |
| | YES | NO | 90 | 0.6 |
| | YES | YES | 90 | 0.025 |

*1"ASM" represents the airflow suppressing member. "YES" is the presence of the airflow suppressing member, and "NO" is the absence of the airflow suppressing member.
*2"NSA" represents the nip surface angle (degrees) relative to the horizontal surface.
*3"CONC" represents the concentration (particles/cm$^3$) of the small diameter particles.

From the experimental result shown in Table 2, with respect to any of the fixing devices 109 in this embodiment, the number of the discharged small diameter particles was able to be suppressed by providing the airflow suppressing member 45R in the gap region V. Further, it is understood that a suppression ratio of the number of the discharged small diameter particles is larger in the fixing devices 109 having the constitution in which the airflow suppressing member 45R is provided in the both longitudinal sides, not in only the longitudinal left side, in the longitudinal gap regions V with respect to the longitudinal direction of the pressing roller 30. Further, it is understood that the suppression ratio of the number of the discharged small diameter particles is larger in the fixing devices 109 having the constitution in which the exit of the nip N is directed upward.

Further, although the result is not shown in Table 2, in also the fixing device 109 having a constitution in which the nip surface angle relative to the horizontal surface is between 0 degrees and 90 degrees, the number of the discharged small diameter particles can be suppressed. As a result, it was confirmed that the suppression ratio was larger with a larger angle.

Also with respect to the fixing device 109 in this embodiment, the airflow suppressing member 45R is provided in the gap region V, and therefore it is possible to obtain the effect described in Embodiment 1. Further, a constitution in which the airflow suppressing member 45R is fixed to the core metal 30A of the pressing roller 30 is employed, and therefore the above-described effect can be obtained without upsizing the fixing device 109 and the image forming apparatus itself.

[Embodiment 7]

Figure 10:
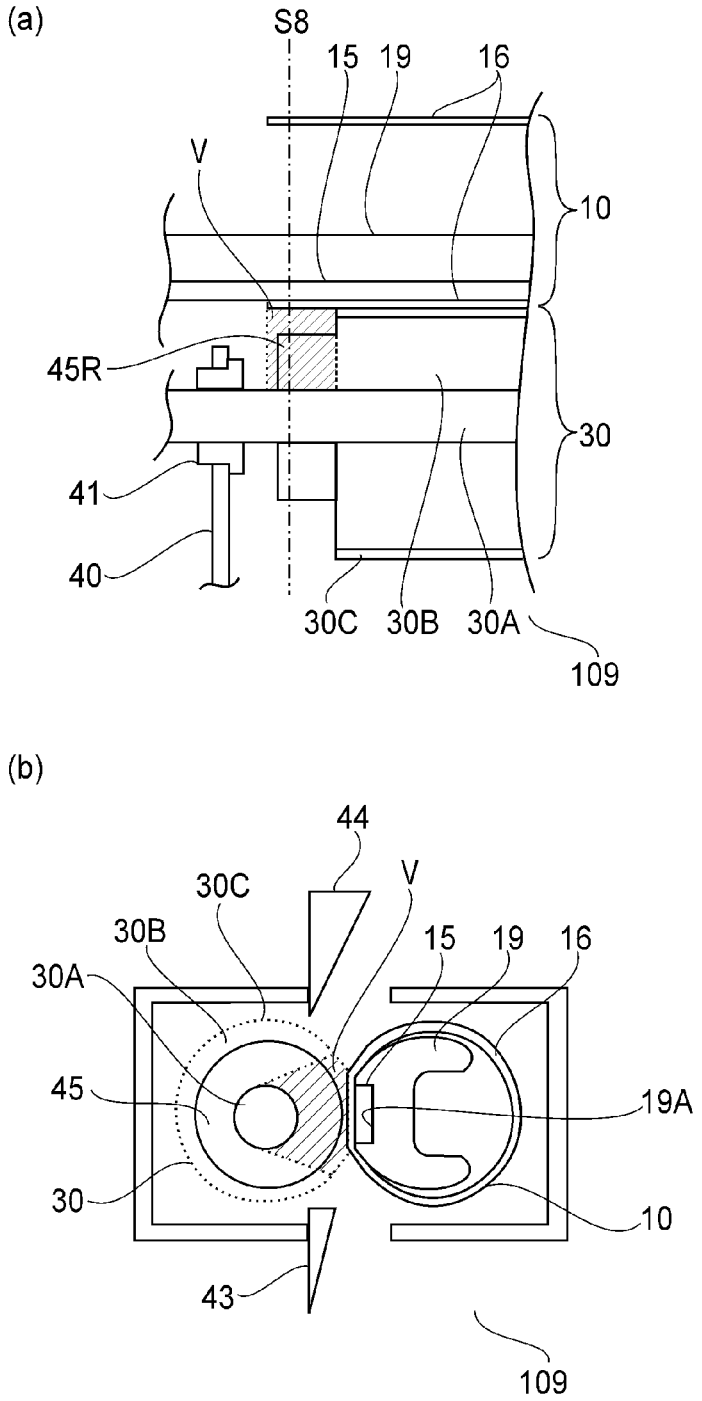
In FIG. 10, (a) is a sectional view of a longitudinal end portion of a film and a pressing roller in a fixing device in Embodiment 7 and the neighborhood of the longitudinal end portion, and (b) is a sectional view of the fixing device in Embodiment 7.

FIG. 10 is an illustration of a fixing device 109 in this embodiment. In FIG. 10, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S8 in (a) of FIG. 10.

The fixing device 109 in this embodiment has the same constitution as the fixing device 109 in Embodiment 1 except that a part of the elastic layer (elastic member) 30B of the frame 30 also functions as the airflow suppressing member 45A.

As shown in (a) and (b) of FIG. 10, a part of the member of the elastic layer 30B of the pressing roller 30 protrudes into the gap region V, and the part of the elastic layer 30B functions as the airflow suppressing member 45R. In other words, the part of the elastic layer 30B also has the function of the airflow suppressing member 45R.

Also in the fixing device 109 in this embodiment, the airflow suppressing member 45R is provided in the gap region V, and therefore the effect described in Embodiment 6 can be obtained. Further, the constitution in which the part of the elastic layer 30B of the pressing roller 30 also functions as the airflow suppressing member 45R is employed, and therefore it is possible to obtain the above-described effect without upsizing the fixing device 109 and the image forming apparatus itself.

[Embodiment 8]

Figure 11:
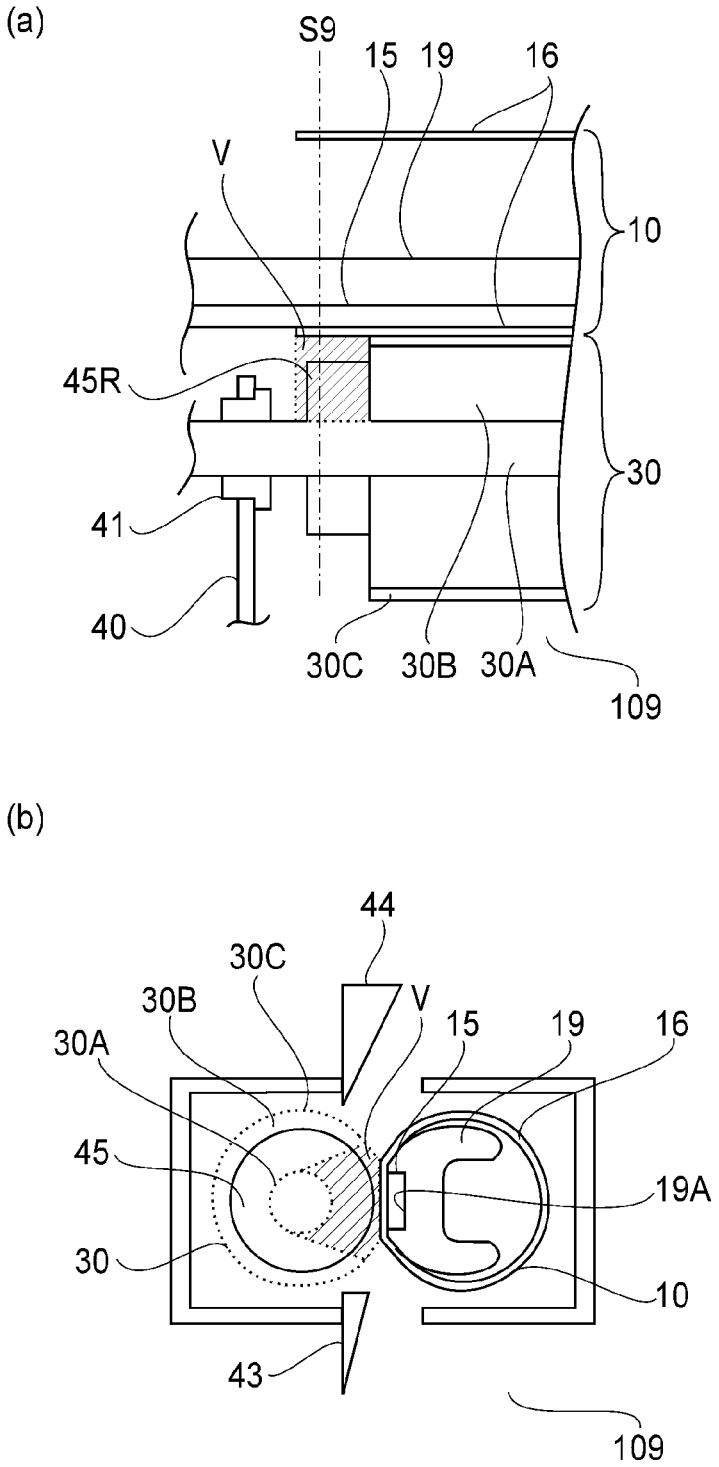
In FIG. 11, (a) is a sectional view of a longitudinal end portion of a film and a pressing roller in a fixing device in Embodiment 8 and the neighborhood of the longitudinal end portion, and (b) is a sectional view the fixing device in Embodiment 8.

FIG. 11 is an illustration of a fixing device 109 in this embodiment. In FIG. 11, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S9 in (a) of FIG. 11.

The fixing device 109 in this embodiment has the same constitution as the fixing device 109 in Embodiment 6 except that the part of the core metal 30A of the pressing roller 30 also functions as the airflow suppressing member 45R.

As shown in (a) and (b) of FIG. 11, the part of the core metal 30A of the pressing roller 30 protrudes into the gap region V and functions as the airflow suppressing member 45. In other words, the part of the core metal 30A of the pressing roller 30 also has the function of the airflow suppressing member 45R.

Also in the fixing device 109 in this embodiment, the airflow suppressing member 45R is provided in the gap region V, and therefore the effect described in Embodiment 6 can be obtained. Further, a constitution in which the part of the core metal 30A of the pressing roller 30 also functions as the airflow suppressing member 45R is employed, and therefore the above-described effect can be obtained without upsizing the fixing device 109 and the image forming apparatus itself.

[Embodiment 9]

Figure 12:
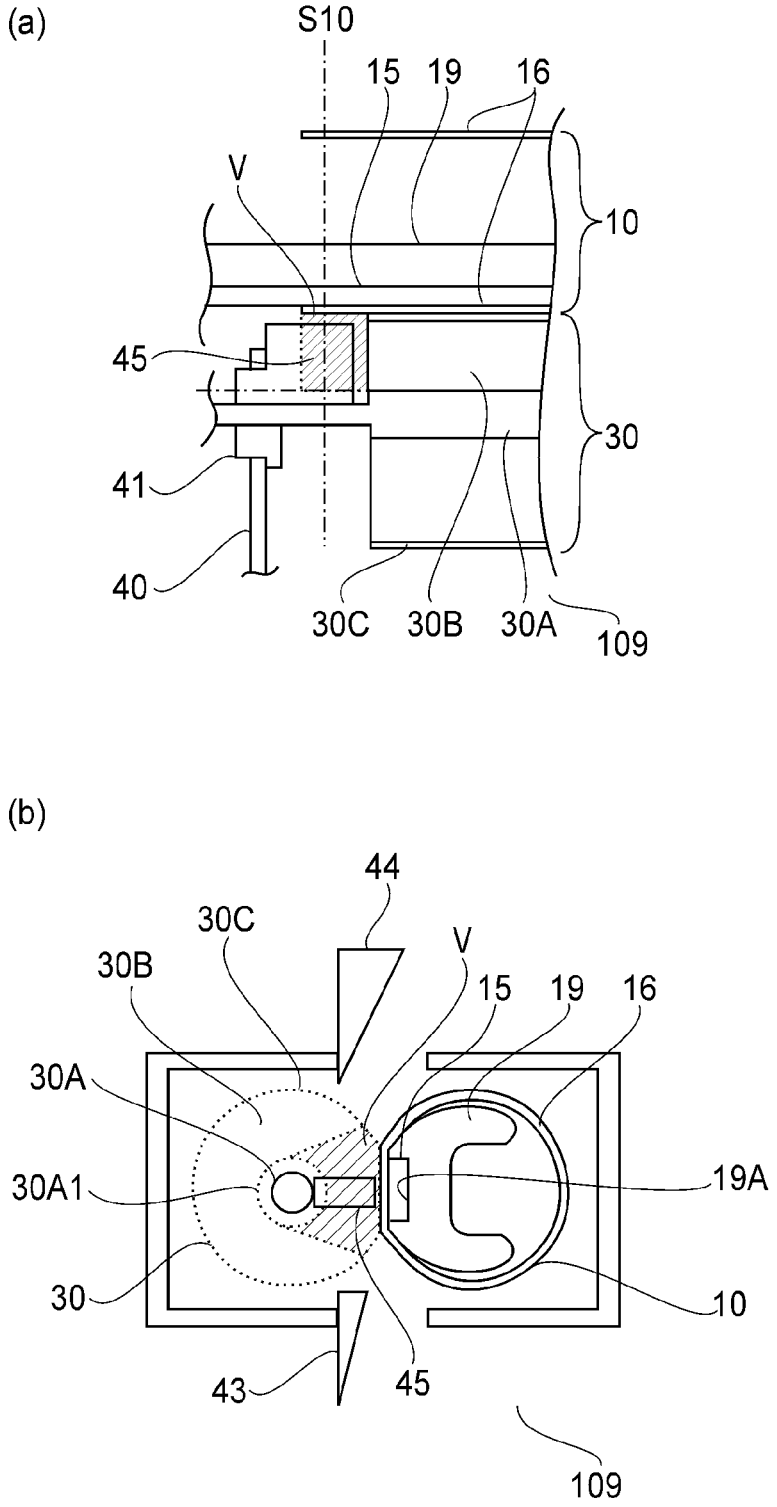
In FIG. 12, (a) is a sectional view of a longitudinal end portion of a film and a pressing roller in a fixing device in Embodiment 9 and the neighborhood of the longitudinal end portion, and (b) is a sectional view of the fixing device in Embodiment 9.

FIG. 12 is an illustration of a fixing device 109 in this embodiment. In FIG. 12, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S10 in (a) of FIG. 12.

The fixing device 109 in this embodiment has the same constitution as the fixing device 109 in Embodiment 1 except that an outer diameter of a shaft-supporting portion 30A1 of the core metal 30A of the pressing roller 30 is made smaller than an outer diameter of each of the core metals 30A of the pressing rollers 30 in Embodiments 1 to 8.

Also in the fixing device 109 in this embodiment, the airflow suppressing member 45 is provided in the gap region V, and therefore the effect described in Embodiment 1 can be obtained. Further, the outer diameter of the shaft-supporting portion 30A1 of the core metal 30A of the pressing roller 30 is smaller than the outer diameter of the core metal 30A of the pressing roller 30 in Embodiment 1, and therefore when the nip N is heated up to the fixing temperature, the thermal capacity absorbed by the airflow suppressing member 45 is decreased, so that energy of the fixing device 109 can be saved. When the constitution of the fixing device 109 in this embodiment is applied to the fixing devices 109 in Embodiments 2 to 8, also with respect to the fixing devices in these embodiments, it becomes possible to save energy of these fixing devices.

[Embodiment 10]

Figure 13:
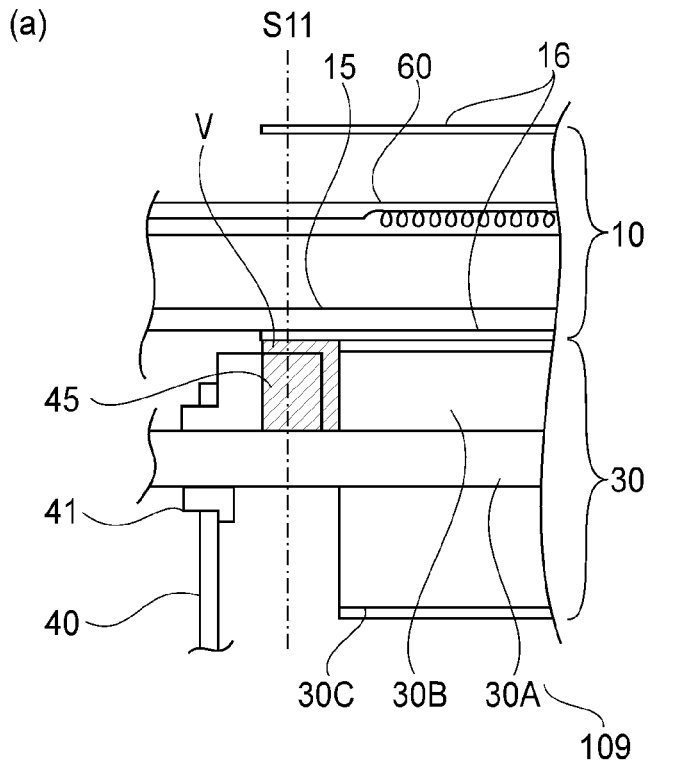
In FIG. 13, (a) is a sectional view of a longitudinal end portion of a film and a pressing roller in a fixing device in Embodiment 10 and the neighborhood of the longitudinal end portion, and (b) is a sectional view the fixing device in Embodiment 10.
Figure 13:
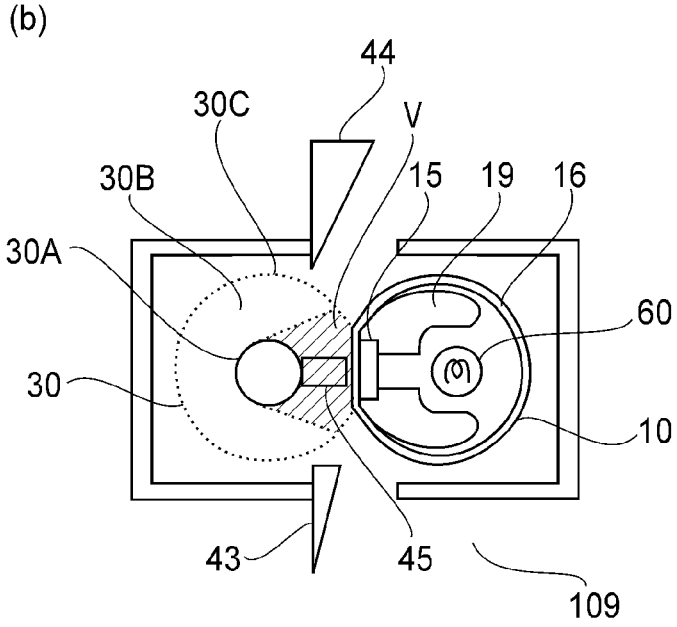

FIG. 13 is an illustration of a fixing device 109 in this embodiment. In FIG. 13, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S11 in (a) of FIG. 13.

The fixing device 109 in this embodiment has the same constitution as the fixing device 109 in Embodiment 1 except that a halogen heater 60 as a heat source is provided inside the film 16 and that a nip-forming member 15 formed of a metal, such as aluminum, having high thermal conductivity is used in place of the heater 15. The film 16 is heated by the heater 60 via the nip-forming member 15.

Also in the fixing device 109 in this embodiment, the airflow suppressing member 45 is provided in the gap region V, and therefore the effect described in Embodiment 1 can be obtained. The constitution of the fixing device 109 in this embodiment may also be applied to the fixing devices 109 in Embodiments 2 to 8.

The position of the halogen heater 60 is not limited to the inside of the film 16, but the halogen heater 60 may also be disposed outside the film 16 to heat the surface of the film 16. It is also possible to employ a constitution in which a film 16 of a self-heat generation type is used to omit the halogen heater 60.

[Embodiment 11]

Figure 14:
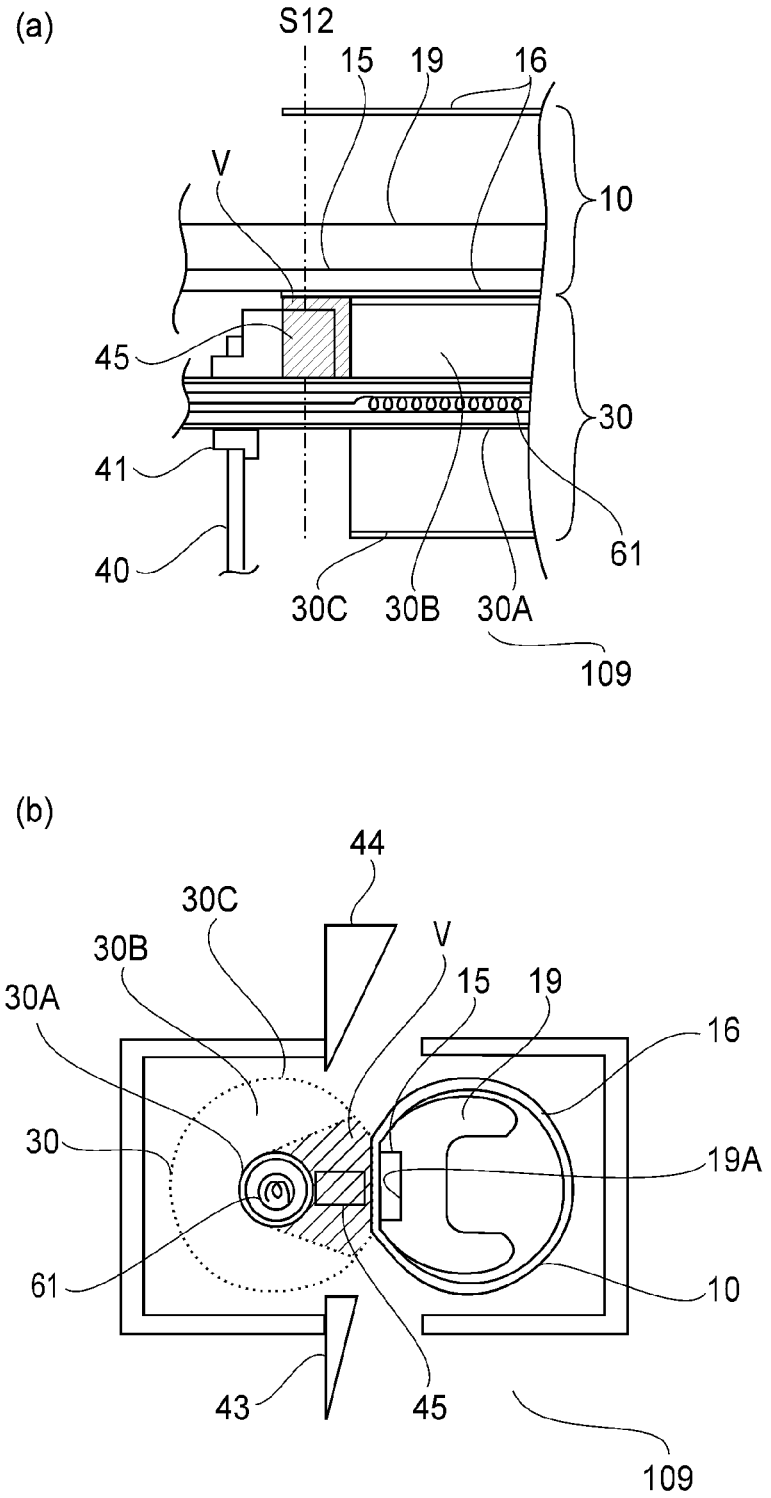
In FIG. 14, (a) is a sectional view of a longitudinal end portion of a film and a pressing roller in a fixing device in Embodiment 11 and the neighborhood of the longitudinal end portion, and (b) is a sectional view of the fixing device in Embodiment 11.

FIG. 14 is an illustration of a fixing device 109 in this embodiment. In FIG. 14, (a) is a sectional view showing a longitudinal end portion of a film 16 and a pressing roller 30 of the fixing device 109 in this embodiment and the neighborhood of the longitudinal end portion, and (b) is a sectional view of the fixing device 109 in this embodiment taken along a chain line S12 in (a) of FIG. 14.

In the fixing device 109 in this embodiment, in place of the heater 15 of the heating unit 10, the nip-forming member 15 formed of a resin material or the like having low friction coefficient is used. The core metal 30A of the pressing roller 30 has a hollow structure, and a halogen heater 61 is provided, as a heat source, inside the core metal 30A. The halogen heater 61 heats the pressing roller 30 from the inside of the pressing roller 30. The recording material carries the toner image on the surface facing the pressing roller 30 and is introduced into the nip N. The fixing device 109 in this embodiment has the same constitution as the fixing device 109 in Embodiment 1 except for the above-described points.

Also in the fixing device 109 in this embodiment, the airflow suppressing member 45 is provided in the gap region V, and therefore the effect described in Embodiment 1 can be obtained. The constitution of the fixing device 109 in this embodiment may also be applied to the fixing devices 109 in Embodiments 2 to 8.

[Embodiment 12]

Figure 15:
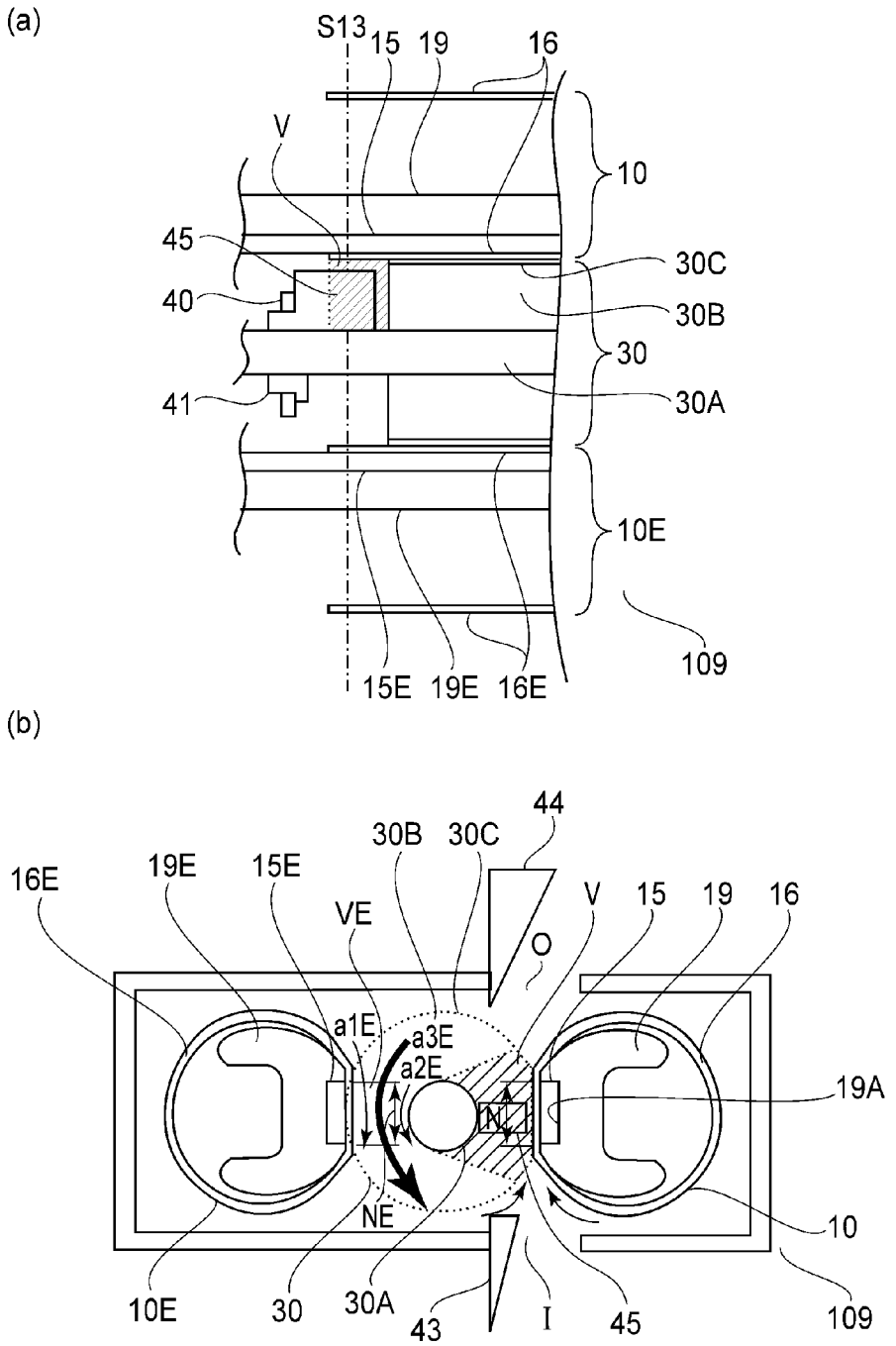
In FIG. 15, (a) is a sectional view of a longitudinal end portion of a film, a pressing roller and a second film in a fixing device in Embodiment 12 and the neighborhood of the longitudinal end portion, and (b) is a sectional view the fixing device in Embodiment 12.

FIG. 15 is an illustration of a fixing device 109 in this embodiment. In FIG. 15, (a) is a sectional view showing a longitudinal end portion of a film 16, a pressing roller 30 and a second film 16E of the fixing device 109 in this embodiment and the neighborhood of the longitudinal end portion, and (b) is a sectional view of the fixing device 109 in this embodiment taken along a chain line S13 in (a) of FIG. 15.

In the fixing device 109 in this embodiment, in place of the heater 15 of the heating unit 10, the nip-forming member 15 formed of a resin material or the like having low friction coefficient is used. In a side opposite from the heating unit 10 with respect to the pressing roller 30, a second heating unit 10E is provided. The halogen heater 61 heats the pressing roller 30 from the inside of the pressing roller 30. The recording material carries the toner image on the surface facing the pressing roller 30 and is introduced into the nip N. The fixing device 109 in this embodiment has the same constitution as the fixing device 109 in Embodiment 1 except for the above-described points.

The second heating unit 10E has the same constitution as the heating unit 10, and includes a second cylindrical film 16E, a second film guide 19 as a second supporting member, a second halogen heater 15E as a second nip-forming member, and the like. The elastic layer 30B of the pressing roller 30 is elastically deformed by the second heater 15E via the second film 16E, so that a second nip NE having a predetermined width is formed between the second pressing roller surface and the second film surface. The second heater 15E heats the pressing roller 30E surface via the second cylindrical film 16E at the second nip NE.

In the fixing device 109 in this embodiment, the second film 16E is rotated in an arrow distance by rotation of the pressing roller 30. Therefore, as shown in (b) of FIG. 15, in a gap VE created between the second film 16E and the core metal 30A of the pressing roller 30, a surface movement direction a1E of the second film 106E and a surface movement direction a2E of the core metal 30A of the pressing roller 30 coincide with each other. For this reason, airflow a3E directed from a recording material outlet O toward a recording material inlet I is generated. This airflow a3E is directed in a direction in which airflow moving together with the recording material P is canceled, and therefore compared with the fixing device 109 in Embodiment 1, it is possible to more effectively reduce the number of the small diameter particles, discharged to the outside of the image forming apparatus, by the airflow suppressing member 45 provided in the gap region V.

The constitution of the fixing device 109 in this embodiment may also be applied to the fixing devices 109 in Embodiments 2 to 8.

[Embodiment 13]

(1) Fixing Device

A fixing device in this embodiment will be described with reference to (a) and (b) of FIG. 16 and FIG. 17. This fixing device is a film heating type fixing device to be mounted in a printer (image forming apparatus) using an electrophotographic recording technology.

Figure 16:
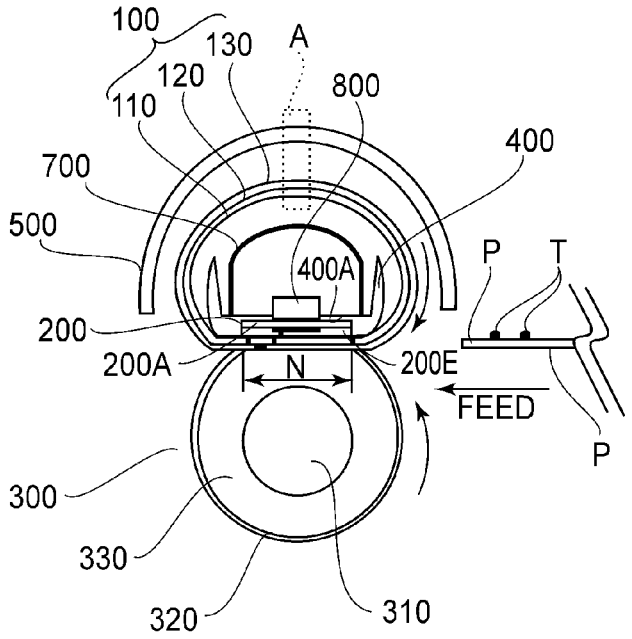
In FIG. 16, (a) is a cross-sectional view of a fixing device in Embodiment 13, and (b) is a schematic view of the fixing device in Embodiment 13 as seen in a feeding direction of a recording material.
Figure 16:
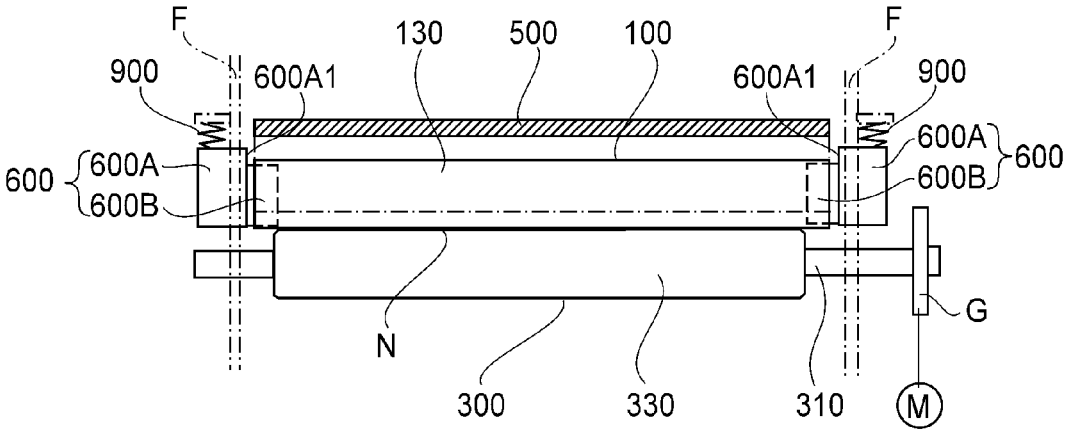
Figure 17:
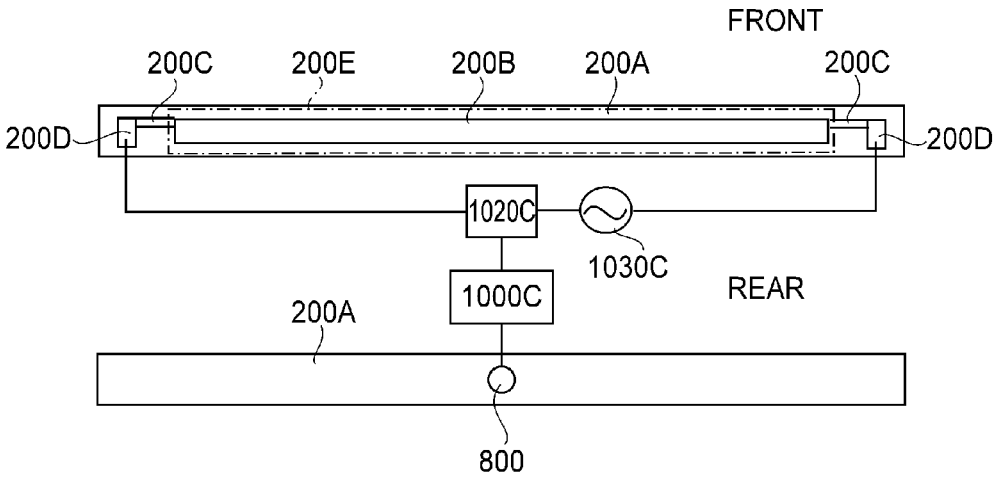
FIG. 17 is a schematic view showing a structure of a heater in Embodiment 13.

In FIG. 16, (a) is a cross-sectional view showing a schematic structure of the fixing device, and (b) is a front view of the fixing device shown in (a) of FIG. 16 as seen from an upstream side of the recording material feeding direction. In (b) of FIG. 16, for convenience of explanation, a cover 500 is cut along a widthwise central portion and is shown. FIG. 17 is a schematic view showing a structure of a heater 200 of the fixing device.

The fixing device includes a cylindrical film (rotatable member) 100, the heater (heating member) 200 for heating the film 100 in contact with an inner peripheral surface (inner surface) of the film 100, and a pressing roller (pressing member) 300 for forming a nip N via the film 100 in combination with the heater 200. Further, the fixing device includes a holder (supporting member) 400 for supporting the heater 200, the cover 500 for covering an outer peripheral surface (outer surface) of the film 100, two flanges 600 for holding end portions of the film 100, a stay 700 for reinforcing the holder 400, and the like. Each of the film 100, the heater 200, the pressing roller 300, the holder 400, the cover 500 and the stay 700 is a long member extending in a direction (longitudinal direction) perpendicular to the recording material feeding direction.

The film 100 has a three-layer structure consisting of a base layer 110, an elastic layer 120 and a surface layer 130. The base layer 110 is a cylindrical base layer having mechanical characteristics such as torsion strength and smoothness, and is formed of a resin material such as polyimide, metal such as SUS, alloy, or the like. The elastic layer 120 formed on the outer peripheral surface of the base layer 110 is formed of a silicone rubber or the like in order to improve followability to the recording material P such as recording paper. There is also the case where the elastic layer 120 is not formed in view of a cost or the like. The surface layer 130 formed on the outer peripheral surface of the elastic layer 120 is formed of PFA or PTFE having a good parting property in order to prevent the film from being contaminated with the toner, paper powder or the like.

In this embodiment, as the film 100, a film of 18 mm in outer diameter and 230 mm in length is used. As the base layer 110, a 30 μm-thick layer of SUS is used. As the elastic layer 120, a 250 μm-thick silicone rubber layer is used. As the surface layer 130, a 30 μm-thick parting layer subjected to coating with PFA.

The heater 200 includes a thin long substrate 200A extending in the longitudinal direction. As the substrate 200A, an insulating ceramic substrate of alumina, aluminum nitride or the like or a heat-resistant resin substrate of polyimide, PPS, a liquid crystal polymer or the like.

On the surface (film slide surface) of the substrate 200A in an inner surface side of the film 100, a heat generating resistor 200B of Ag/Pd (silver/palladium) or the like is coated and formed in a line shape or a fine strip shape by screen printing or the like. Further, on the film slide surface of the substrate 200A in the film 100 side, an electroconductive portion 200C for supplying electric power to the heat generating resistor 200B and an electrode 200D for supplying the electric power to the heat generating resistor 200B via the electroconductive portion 200C are coated and formed in a fine strip shape by screen printing or the like. Further, on the film slide surface of the substrate 200A, for the purpose of ensuring protection and insulation of the heat generating resistor 200B, an insulating protective layer 200E formed of, e.g., glass, polyimide resin or the like is formed so as to cover the heat generating resistor 200B.

To the surface (non-film slide surface) of the substrate 200A in a side opposite from the film slide surface, a temperature detecting element 800 such as a thermistor is contacted at a longitudinal central portion of the substrate 200A.

In this embodiment, as the heater 200, a heater which employs alumina as a material for the substrate 200A and which forms the heat generating resistor 200B of Ag/Pd on the substrate 200A and which then forms the glass-coated insulating protective layer 200E on the heat generating resistor 200B is used. Further, a size of the substrate 200A is such that the substrate 200A is 5.83 mm in width with respect to a direction (widthwise direction) parallel to the recording material feeding direction 270 mm in longitudinal length, and 1 mm in thickness.

The pressing roller 300 includes a core metal 310 formed of a material such as iron or aluminum. On the other peripheral surface of the core metal 310 between longitudinal end portions 310A, an elastic layer 320 is formed of a material such as a silicone rubber. On the other peripheral surface of the elastic layer 320, a parting layer 330 is formed of a material such as PFA. A hardness of the pressing roller 300 may preferably be 40-70 degrees, as measured by Asker-C hardness meter under a load of 9.8 N (1 kgf), so as to satisfy a widthwise width of the nip N satisfying a fixing property, and a durability. The pressing roller 300 is rotatably supported by a frame F of the fixing device at a shaft portion 310A provided at longitudinal end portions of the core metal 310 thereof.

In this embodiment, as the pressing roller 300, a roller prepared by forming a 3.5 t-thick silicone rubber layer is the elastic layer 320 on an aluminum core metal 31 of 13 mm in diameter and coating a 40 μm-thick electroconductive PFA tube on the silicone rubber layer is used. The pressing roller 300 is 60 degrees in hardness and 20 mm in diameter, and the elastic layer 320 is 226 mm in longitudinal length.

The holder 400 is formed of a heat-resistant resin material such as a liquid crystal polymer, PPS or PET in a substantially U (recessed)-shape in cross section. This holder 400 supports the heater 200 by a groove 400A formed along a longitudinal direction of a flat surface thereof directed toward the pressing roller 300.

The stay 700 is provided on the flat surface of the holder 400 in a side opposite from the groove 400A. This stay 700 is used for uniformly transmitting a pressing force, to the holder 400 with respect to the longitudinal direction, applied to longitudinal end portions of the stay 700 by a pressing spring 900 described later. For that purpose, a rigid material such as iron, stainless steel or zinc-coated steel plate is used, and rigidity is enhanced by forming the stay 700 in the substantially U-shape in cross section.

The flange 600 provided at the longitudinal end portion of the film 100 is formed of the heat-resistant resin material such as the liquid crystal polymer, PPS or PET. The frame 600 includes a limiting portion 600A for limiting movement of the film 100 in the longitudinal direction and includes a supporting portion 600B for supporting an inner surface of the longitudinal end portion of the film 100. The longitudinal end portion of the holder 400 and the longitudinal end portion of the stay 700 are supported by the limiting portion 600A of the flange 600, and the flange 600 is disposed in parallel to the film 100 and is supported by the frame F via the limiting portion 600A. The supporting portion 600B projects from a limiting surface 600A1 of the limiting portion 600A where the film end portion abuts against the limiting surface 600A1 when the film 100 moves in the longitudinal direction.

The pressing spring 900 provided between the frame F and the limiting portion 600A of the flange 600 presses the longitudinal end portions of the stay 700 via the flange 600 in a direction perpendicular to a generatrix direction of the holder 400. As a result, the stay 700 presses the longitudinal end portions of the holder 400 in the same direction to press the heater 200 toward the surface of the pressing roller 300 via the film 100. As a result, the elastic layer 330 of the pressing roller 300 is collapsed and elastically deformed, so that a longitudinally uniform nip N ((a) of FIG. 16) having a predetermined width is formed by the surface of the pressing roller 300 and the surface of the film 100.

In this embodiment, the liquid crystal polymer is used as the material for the holder 400 and PET is used as the material for the flange 600. A length in which the supporting portion 600B of the flange 600 supports the inner surface of the film 100 is 10 mm. As the material for the stay 700, the zinc-coated steel plate is used. A pressing force applied to the pressing roller 300 is 196N (20 kgf), and the nip N width of 7 mm is obtained at this time.

(2) Heat-fixing Operation of Fixing Device

A heat-fixing operation of the fixing device will be described with reference to (a) and (c) of FIG. 16 and FIG. 17. A driving force of a motor M is transmitted to a gear G provided at a longitudinal end portion of the core metal 310 of the pressing roller 300, so that the pressing roller 300 is rotated in an arrow direction. The film 100 is rotated in an arrow direction by rotation of the pressing roller 300 while sliding with the heater 200 at the inner surface thereof. In this embodiment, by rotation of the pressing roller 300 and the film 100, the recording material P is fed at a speed of 120 mm/sec.

To the heat generating resistor 200B of the heater 200, electric power is supplied from a commercial power source 1030 via a triac 1020, so that the heat generating resistor 200B generates heat and thus the heater 200 is increased in temperature. The triac 1020 is controlled by a controller 1000 including CPU and memories such as RAM and ROM so that a detection temperature of a temperature detecting element 800 for detecting a temperature of the substrate 15A in a side opposite from the contacting surface with the film 100 is kept at a fixing temperature (target temperature) of 230° C.

The recording material P carrying thereon a toner image (unfixed toner image) T is introduced into the nip N. Then, while the recording material P is nipped and fed through the nip N, heat of the heater 200 and pressure at the nip N are applied to the toner image T, so that the toner image T is heat-fixed on the recording material P. The recording material P comes out of the nip N.

(3) Cover

The cover 500 is formed of the heat-resistant resin material such as PPS or PET. This cover 500 is formed in a substantially semicircular shape in cross section so as to cover the substantially entire region except for the nip N over the surface of the film 100 with respect to a circumferential direction. This cover 500 is supported at longitudinal end portions thereof by a supporting member (not shown) such as a bracket and is provided to cover the film 100 in the neighborhood of the film 100 in order to prevent heat generated by the heater 200 from escaping.

The longitudinal end portions of the film 100 are rotated while being supported by the supporting portion 600B of the flange 600, and therefore the outer surface of the film 100 is not readily deviated in a radial direction. On the other hand, a longitudinal central portion of the film 100 can be rotated without being limited by a portion other than the nip N, so that at a position in an opposite side remotest from the nip N with respect to the rotational direction of the film 100, the outer surface of the film 100 is liable to be deformed by being deviated to the outside.

Figure 18:
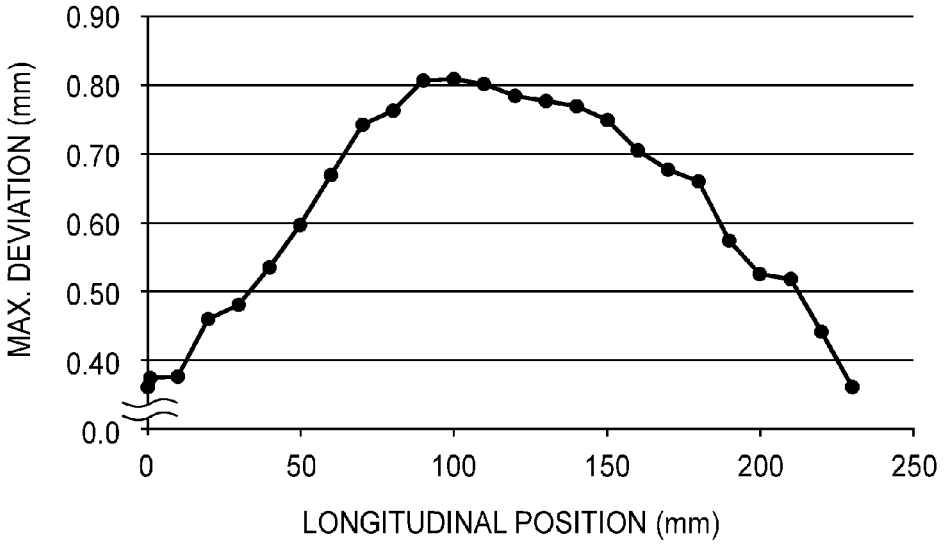
FIG. 18 is a graph showing a deviation amount of a film with respect to a radial direction of the film.

In the fixing device in this embodiment, a deviation amount of the film 100 with respect to the longitudinal direction when the recording material P is fed through the nip N is shown in FIG. 18. In FIG. 18, the supporting surface 600B1 ((b) of FIG. 19) supporting, at the supporting portion 600B of the flange 600, the inner surface of the film 100 immediately below the cover 500 at a widthwise central portion of the cover is used as a basis (zero). At the longitudinal end portions of the film 100, the film inner surface is supported by the flange 600 and therefore the deviation amount approaches zero, and at the longitudinal central portion where the film is limited only at the nip N, the deviation amount becomes large. When the cover 500 contacts the outer surface of the film 100, improper fixing is generated by breaking of the film 100 and taking of the heat of the film 100 by the cover 500, and therefore the cover 500 has been conventionally disposed in consideration of a component tolerance and a maximum deviation amount of the film 100 at the longitudinal central portion.

In this embodiment, the shape of the cover 500 is optimized in consideration of the longitudinal deviation amount of the film 100 shown in FIG. 18. For this reason, compared with a conventional constitution, the cover 500 can be disposed close to the film 100.

Figure 19:
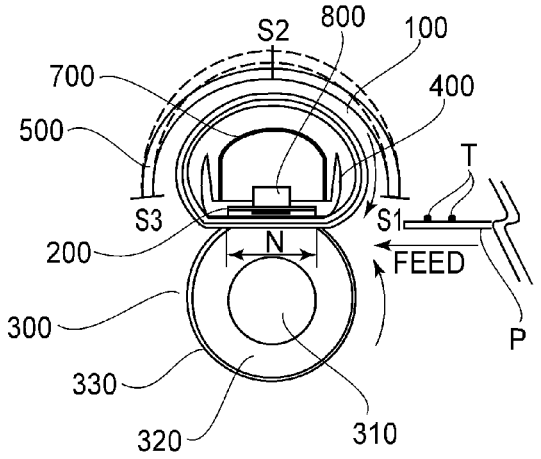
In FIG. 19, (a) is a cross-sectional view of the fixing device in Embodiment 13, (b) is a schematic view showing a longitudinal structure of a film, a flange and a cover in Embodiment 13, and (c) is a table showing a distance between the cover and the film with respect to a radial direction in Comparison Example 3, Comparison Example 4 and Embodiment 13.
Figure 19:
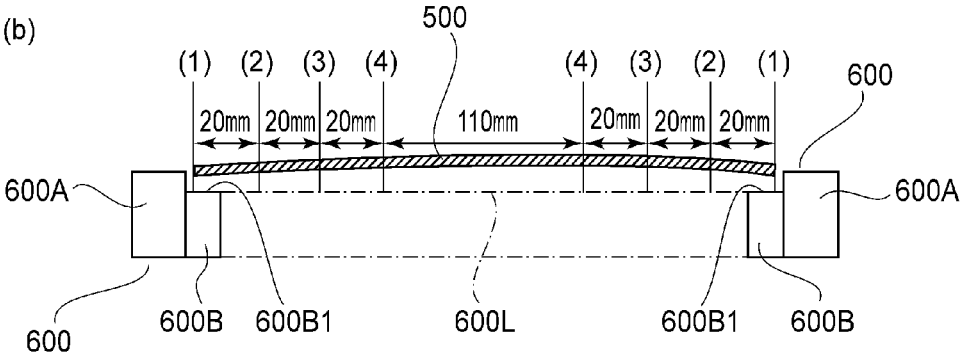

Here, a cross-sectional surface of the cover 500 in this embodiment is shown in (a) of FIG. 19. A phantom surface obtained by extending the supporting surface 600B1 of the supporting portion 600B of the flange 600 in the longitudinal direction is taken as 600L. In FIG. 19, (b) is a schematic view showing the longitudinal shape of the cover 500. A distance between the phantom surface 600L and the inner surface of the cover 500 with respect to a radial direction of the film 100 at a position S2 remotest from the nip N with respect to the rotational direction of the film 100 is shown in (c) of FIG. 19. Specifically, the distance between the phantom surface 600L and the inner surface of the cover 500 with respect to the radial direction of the film at each of four positions (1) to (4) ranging from a longitudinal end portion toward a longitudinal central portion is shown. In each of Comparison Examples 3 and 4, a constitution in which the direction is constant with respect to the longitudinal direction is employed.

In (a) of FIG. 19, a broken line and a solid line indicate cross-sectional shapes of the cover 500 in Embodiment 13 at the longitudinal central portion and the longitudinal end portion, respectively, of the cover 500. At the longitudinal end portion of the cover 500, the distance between the phantom surface 600L and the inner surface of the cover 500 is shorter than the distance at the longitudinal central portion. With respect to the rotational direction of the film 100, at the position S2, the deviation amount of the film 100 with respect to the radial direction is largest, and therefore the inner surface of the cover 500 is spaced from the phantom surface 600L in the radial direction, so that the distance is increased.

(4) Small Diameter Particles of Parting Wax Contained in Toner

A parting wax is incorporated in the toner of the toner image carried on the recording material P. As described above, most of the parting wax is transferred together with the melted toner image T onto the recording material P and then is fixed on the recording material P, but a part of the toner is vaporized in a gas state (phase). A vaporized parting wax component floats in the air in the fixing device in the form of ultrafine particles (small diameter particles) in liquid phase or solid phase depending on the ambient temperature. At this time, by floating the small diameter particles in the air in the fixing device for a long time, the small diameter particles are agglomerated or caught by peripheral members, so that it is possible to reduce the number of the small diameter particles discharged from the fixing device.

Figures 20, 21:
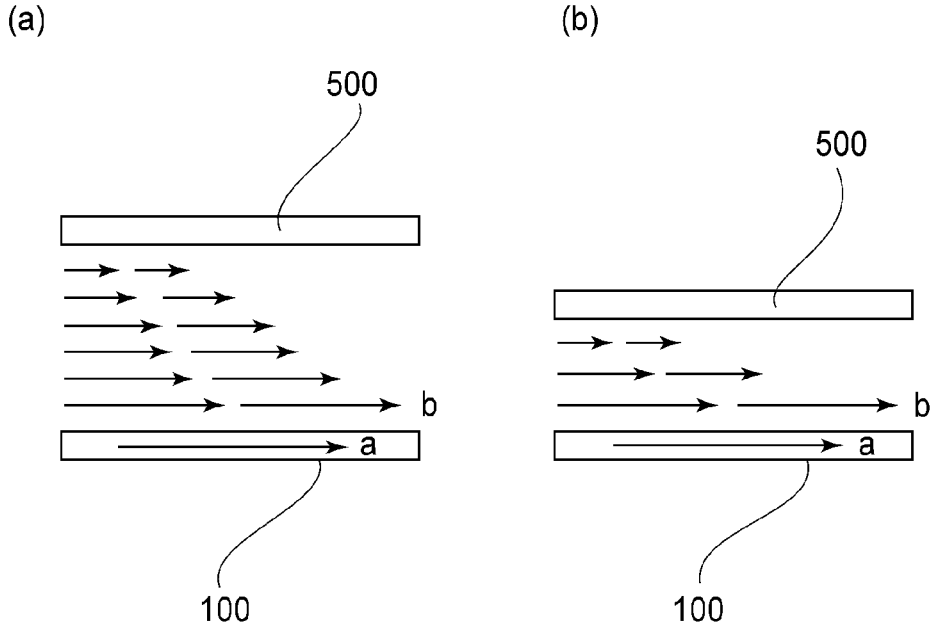
FIG. 20 is a table showing temperatures of the recording material, the film and the pressing roller during fixing.
In FIG. 21, (a) is a schematic view showing airflow between the film and the cover when the distance between the film and the cover is long, and (b) is a schematic view showing airflow between the film and the cover when the distance between the film and cover is short.

When the toner wax used in the image forming apparatus in which the fixing device in this embodiment is mounted is heated alone, the small diameter particles are generated from a temperature in the neighborhood of 145° C. For that reason, in the image forming apparatus, a generation source of the small diameter particles includes the recording material P on which the toner wax is deposited and which is to be increased in temperature, and includes the surface of the film 100 and the surface of the pressing roller 300. Under the condition in this embodiment, surface temperatures of the recording material P, the film 100 and the pressing roller 300 when the recording material P is fed through the nip N are shown in FIG. 20. From FIG. 20, it would be considered that a member having a temperature of 145° C. or more is only the film 100 and therefore the small diameter particles are generated from the surface of the fixing film 100.

The discharge of the small diameter particles to the outside of the fixing device is affected by the airflow, and therefore the airflow in the neighborhood of the fixing film 100 will be described with reference to FIG. 21.

In FIG. 21, (a) and (b) are enlarged views each showing a portion A of the fixing device shown in (a) of FIG. 16 and showing airflow generated at a periphery of the film surface with rotation of the film 100.

As shown in (a) of FIG. 21, the film 100 moves in a direction indicated by arrow a, and therefore is influenced by viscosity of the airflow, so that airflow as indicated by arrows b is generated in the neighborhood of the film 100. It would be considered that the small diameter particles generated at the surface of the film 100 are carried by the airflow and then are discharged together with the recording material P to the outside of the fixing device. However, also gas in the neighborhood of the inner surface of the cover 500 being at rest is influenced by the airflow due to the viscosity of the gas, and therefore as in this embodiment shown in (b) of FIG. 21, the airflow is suppressed by bringing the cover 500 near to the film 100, so that the generated small diameter particles are readily caused to remain inside the fixing device.

In the fixing device in this embodiment, in consideration of a change in longitudinal shape of the outer surface of the film 100 when the recording material P is fed through the nip N, the shape of the cover 500 is designated as follows. That is, at a position opposite from the nip N, the shape of the cover 500 is such that the longitudinal end portions are shorter than the longitudinal central portion. As a result, compared with Comparison Example 4, the cover 500 can be disposed closer to the film 100 with no contact between the film 100 and the cover 500.

Then, a result of evaluation of discharge amounts of the small diameter particles to the outside of image forming apparatuses in which the fixing devices in Comparison Example 3, Comparison Example 4 and Embodiment 13 (this embodiment), respectively, are mounted will be described. An evaluation method was such that an inside of a hermetically sealed chamber of 3 $m^3$ in volume is filled with cleaned air in N/N environment (temperature: 23° C./humidity: 50% RH), and the image forming apparatus was disposed in the chamber, and then a concentration (density) of the small diameter particles after an image of 5% in print ratio was continuously printed for 10 minutes was measured. For measurement, a nano-particle size distribution measuring device ("FMPS3091", manufactured by TSI Inc.) was used.

In the evaluation result, in this embodiment, compared with Comparison Example 4, the discharge amount of the small diameter particles to the outside of the image forming apparatus was decreased by 7%. This is because in this embodiment, the cover 500 can be disposed closer to the film 100 than in the case of Comparison Example 4 and therefore the airflow is affected by viscosity thereof and thus the airflow flowing between the cover 500 and the film 100 can be suppressed. On the other hand, in Comparison Example 1, the small diameter particles-reducing effect equivalent or superior to that in this embodiment was achieved, but image defect which would be attributable to the contact between the film 100 and the cover 500 was generated.

As described above, by employing the constitution in which the longitudinal shape of the cover 500 is such that the distance between the phantom surface 600L and the inner surface of the cover 500 is made shorter at the longitudinal end portions than at the longitudinal central portion, the cover 500 can be disposed close to the film 100 with no contact with the film 100. As a result, it is possible to achieve the action such that the discharge of the small diameter particles, generated from the surface of the film 100, to the outside of the image forming apparatus can be suppressed. The small diameter particles are caused to float in the air in the fixing device for a long time, so that the small diameter particles agglomerate each other and are caught by a peripheral member, and therefore it is possible to suppress the discharge amount of the small diameter particles to the outside of the image forming apparatus. Further, in this embodiment, by employing a simple constitution such that the shape of the cover 500 is changed without adding a new member, it is possible to suppress the discharge of the small diameter particles to the outside of the image forming apparatus.

Figure 22:
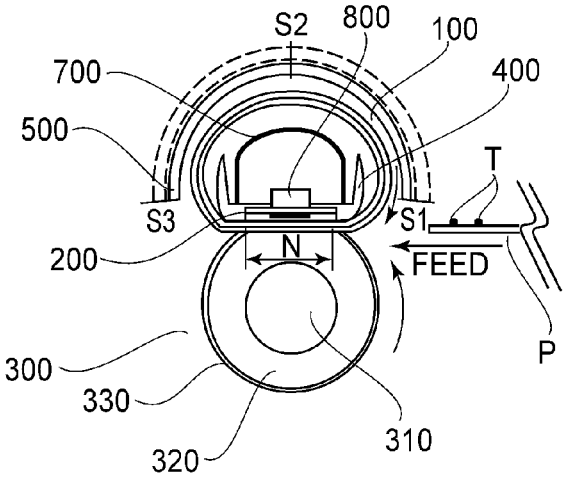
In FIG. 22, (a) is a cross-sectional view of the fixing device in a modified example of Embodiment 13, (b) is a schematic view showing a longitudinal structure of a film, a flange and a cover in the modified example of Embodiment 13, and (c) is a table showing a distance between the cover and the film with respect to a radial direction in Comparison Example 3, Comparison Example 4 and the modified example of Embodiment 13.
Figure 22:
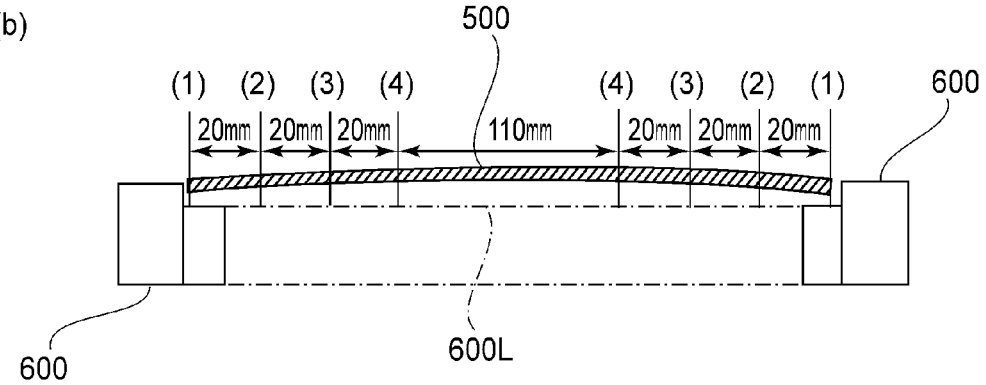

In Embodiment 13, the constitution in which the distance between the phantom surface 600L and the inner surface of the cover 500 at the position S2 remotest from the nip with respect to the rotational direction of the film 100 is shorter at the longitudinal end portions than at the longitudinal central portion is employed. However, as a modified example of Embodiment 13, a constitution in which the distance between the phantom surface 600L and the inner surface of the cover 500 is shorter at the longitudinal end portions than at the longitudinal central portion over the circumferential direction of the film 100 may also be employed. A cross section of a fixing device having this constitution is shown in (a) of FIG. 22. A longitudinal shape of a cover 500 at a position S2 in (a) of FIG. 22 and a radial distance between the cover 500 and a phantom surface 600L are shown in (b) of FIG. 22. Further, (c) of FIG. 22 is a table showing the radial distances between the phantom surface 600L and the inner surface of the cover 500 at four longitudinal positions (1) to (4) with respect to circumferential positions S1, S2 and S3 of the cover 500.

In the modified example of Embodiment 13, compared with Comparison Example 4, it was possible to reduce the discharge amount of the small diameter particles to the outside of the image forming apparatus by 23% with no contact of the cover 500 with the film 100. That is, in the modified example, the reducing effect of the discharge amount of the small diameter particles to the outside of the image forming apparatus was about 3 times larger than that of Embodiment 13. This would be considered because in the modified example, compared with Embodiment 13, the airflow flowing between the cover 500 and the film 100 can be suppressed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 086375/2013 filed Apr. 17, 2013, 095195/2013 filed Apr. 30, 2013 and 060011/2014 filed Mar. 24, 2014, which are hereby incorporated by reference.

What is claimed is:

1. An image forming apparatus for forming a toner image on a recording material, comprising:

an image forming portion configured to form the toner image on the recording material;

a fixing portion configured to fix the toner image on the recording material; and a spacer, wherein said fixing portion includes a cylindrical film, a contacting member contacting an inner surface of said film and a roller, including a shaft portion and an elastic layer formed outside said shaft portion, forming a pressing portion together with said contacting member via said film, wherein an end surface of said film is positioned outside an end surface of said elastic layer of said roller with respect to a generatrix direction of said film, wherein said spacer occupies at least a part of an interspace between a virtual plane including the end surface of said film and the end surface of said elastic layer, and wherein said spacer does not contact an outer surface of said film.

2. The apparatus according to claim 1, wherein said fixing portion includes a bearing, provided at an end portion of said shaft portion in the generatrix direction, for supporting said shaft portion, and wherein said spacer is provided as a part of said bearing.

3. The apparatus according to claim 2, wherein said spacer is in non-contact with said shaft portion.

4. The apparatus according to claim 1, wherein said spacer has a surface opposing an outer peripheral surface of said shaft portion with a gap.

5. The apparatus according to claim 1, wherein said fixing portion includes a heating unit for heating said roller, and said roller is contactable to the toner image.

6. The apparatus according to claim 1, wherein said contacting member is a heater, and said film is contactable to the toner image.

7. The apparatus according to claim 1, wherein said spacer is provided at each of end portions of said roller in the generatrix direction.

8. The apparatus according to claim 1, wherein said spacer does not rotate with said roller.

9. The apparatus according to claim 1, wherein the pressing portion is a nip for conveying the recording material.

10. The apparatus according to claim 9, further comprising a guiding member configured to guide the recording material at an entrance to the nip, wherein said spacer is provided as a part of said guiding member.

11. The apparatus according to claim 9, further comprising a guiding member configured to guide the recording material at an exit from the nip, wherein said spacer is provided as a part of said guiding member.

12. An image forming apparatus for forming a toner image on a recording material, comprising:

an image forming portion configured to form the toner image on the recording material;

a fixing portion configured to fix the toner image on the recording material; and a spacer, wherein said fixing portion includes a cylindrical film, a contacting member contacting an inner surface of said film and a roller, including a shaft portion and an elastic layer formed outside said shaft portion, forming a pressing portion together with said contacting member via said film, wherein an end surface of said film is positioned outside an end surface of said elastic layer of said roller with respect to a generatrix direction of said film, wherein said spacer occupies at least a part of an interspace between a virtual plane including the end surface of said film and the end surface of said elastic layer, and wherein said spacer does not rotate with said roller.

13. The apparatus according to claim 12, wherein said fixing portion includes a bearing, provided at an end portion of said shaft portion in the generatrix direction, for supporting said shaft portion, and wherein said spacer is provided as a part of said bearing.

14. The apparatus according to claim 13, wherein said spacer is in non-contact with said shaft portion.

15. The apparatus according to claim 14, wherein said spacer has a surface opposing an outer peripheral surface of said shaft portion with a gap.

16. An image forming apparatus for forming a toner image on a recording material, comprising:

an image forming portion configured to form the toner image on the recording material;

a fixing portion configured to fix the toner image on the recording material; and a spacer, wherein the fixing portion includes a first rotating member and a second rotating member that forms a pressing portion with the first rotating member, wherein with respect to a generatrix direction of the first rotating member, a first end surface of a part of the first rotating member including a surface contacting the recording material is positioned outside a second end surface of a part of the second rotating member including a surface contacting the recording material, wherein said spacer occupies at least a part of an interspace between a virtual plane including the first end surface and the second end surface, and wherein the spacer does not contact an outer surface of the first rotating member.

17. An image forming apparatus for forming a toner image on a recording material, comprising:

an image forming portion configured to form the toner image on the recording material;

a fixing portion configured to fix the toner image on the recording material; and a spacer, wherein the fixing portion includes a first rotating member and a second rotating member that forms a pressing portion with the first rotating member, wherein a first end surface of a part of the first rotating member including a surface contacting the recording material is positioned outside a second end surface of a part of the second rotating member including a surface contacting the recording material in a generatrix direction of the first rotating member, wherein said spacer occupies at least a part of an interspace between a virtual plane including the first end surface and the second end surface, and wherein said spacer does not rotate with said second rotating member.

* * * * *